US007079103B2

(12) United States Patent
Morita

(10) Patent No.: US 7,079,103 B2
(45) Date of Patent: Jul. 18, 2006

(54) SCAN-DRIVING CIRCUIT, DISPLAY DEVICE, ELECTRO-OPTICAL DEVICE, AND SCAN-DRIVING METHOD

(75) Inventor: Akira Morita, Suwa (JP)

(73) Assignee: Seiko Epson Corporation (JP)

( * ) Notice: Subject to any disclaimer, the term of this patent is extended or adjusted under 35 U.S.C. 154(b) by 409 days.

(21) Appl. No.: 10/154,484

(22) Filed: May 23, 2002

(65) Prior Publication Data

US 2002/0196241 A1 Dec. 26, 2002

(30) Foreign Application Priority Data

May 24, 2001 (JP) ..... 2001-155196

(51) Int. Cl.
*G09G 3/36* (2006.01)

(52) U.S. Cl. ..... 345/98; 345/204

(58) Field of Classification Search ..... 345/87, 345/88, 89, 90–100, 205, 206
See application file for complete search history.

(56) References Cited

U.S. PATENT DOCUMENTS

| | | | | |
|---|---|---|---|---|
| 5,017,914 | A * | 5/1991 | Uchida et al. | 345/89 |
| 6,281,890 | B1 * | 8/2001 | Ito | 345/204 |
| 6,522,319 | B1 * | 2/2003 | Yamazaki | 345/103 |
| 6,597,119 | B1 * | 7/2003 | Ito | 315/169.1 |
| 6,636,193 | B1 * | 10/2003 | Asao et al. | 345/96 |
| 6,664,943 | B1 * | 12/2003 | Nakajima et al. | 345/98 |
| 6,683,603 | B1 * | 1/2004 | Murai et al. | 345/204 |

FOREIGN PATENT DOCUMENTS

| | | |
|---|---|---|
| JP | 04-165329 | 6/1992 |
| JP | 07-036406 | 2/1995 |
| JP | 09-055909 | 2/1997 |
| JP | 09-127920 | 5/1997 |
| JP | 2000-181414 | 6/2000 |
| JP | 2001-109439 | 4/2001 |
| JP | 2001-343928 | 12/2001 |
| KR | 1999-0038477 | 6/1999 |

OTHER PUBLICATIONS

Communication from Korean Patent Office regarding counterpart application.
Communication from the Japanese Patent Office regarding related application.

* cited by examiner

*Primary Examiner*—Patrick N. Edouard
*Assistant Examiner*—Jean Lesperance
(74) *Attorney, Agent, or Firm*—Harness, Dickey & Pierce, P.L.C.

(57) ABSTRACT

A scan-driving circuit capable of increasing image quality and decreasing power consumption, a display device using the scan-driving circuit, an electro-optical device, and a scanning drive method. The scan-driving circuit includes a shift register, level shifter, and scan line drive circuit. The shift register sequentially shifts an enable input/output signal EIO. The enable input/output signal EIO shifted to a block set for a non-display area is bypassed by block select data set in units of blocks divided for a given number of scan lines. The scan lines in the block set for a display area are driven by the shifted enable input-output signal EIO. The scan lines in the block set for the non-display area are driven by a common electrode voltage polarization inversion signal VCOM and a write enable signal WEN.

11 Claims, 19 Drawing Sheets

50
58
SCAN LINE DRIVE CIRCUIT
54
LEVEL SHIFTER
52
SHIFT REGISTER
BLOCK BQ
BLOCK B1
BLOCK B0
GN
GN-7
G16
G9
G8
G1
2121
2120
2068
2061
2108
2088
2048
2101
2081
2041
LS8
LS1
FF8
FF1
L/SB0
FFB0
200
202
56
L/S
VCOM
WEN
XOEV
EIO
CLK
BLK
BCLK

SCAN-DRIVING CIRCUIT, DISPLAY DEVICE, ELECTRO-OPTICAL DEVICE, AND SCAN-DRIVING METHOD

Japanese Patent Application No. 2001-155196 filed on May 24, 2001, is hereby incorporated by reference in its entirety.

TECHNICAL FIELD

The present invention relates to a scan-driving circuit, a display device and an electro-optical device using the same, and a scan-driving method.

BACKGROUND

A liquid crystal panel is used for a display section of electronic equipment such as a portable telephone in order to reduce power consumption, size, and weight of the electronic equipment. In recent years, use of portable telephones has widened and still images and moving images valuable as information are distributed. Accompanied by this, an increase in image quality of the liquid crystal panel has been demanded.

An active matrix type liquid crystal panel using a thin film transistor (hereinafter abbreviated as "TFT") liquid crystal is known as a liquid crystal panel capable of realizing an increase in image quality of the display section of the electronic equipment.

SUMMARY

One aspect of the present invention relates to a scan-driving circuit which drives first to Nth scan lines (N is a natural number) of an electro-optical device having pixels specified by the first to Nth scan lines and first to Mth signal lines (M is a natural number), the first to Nth scan lines and the first to Mth signal lines being intersect each other, the scan-driving circuit comprising:

a shift register which includes serially connected first to Nth flip-flops provided corresponding to the first to Nth scan lines and sequentially shifts a given pulse signal;

a level converter circuit including first to Nth level shifter circuits which shift voltage levels of output nodes of the first to Nth flip-flops and output signals of the shifted voltage levels; and a scan line drive circuit including first to Nth drive circuits which sequentially drive the first to Nth scan lines corresponding to logic levels of output nodes of the first to Nth level shifter circuits, wherein, when the first to Nth scan lines are divided into blocks each of which includes a plurality of scan lines and selection of a display area or a non-display area is performed in units of the blocks, the scan line drive circuit sequentially drives scan lines in at least one of the blocks selected for the display area, and simultaneously drives at a given drive timing at least part of scan lines in at least one of the blocks selected for a non-display area.

Another aspect of the present invention relates to a method of driving a scan-driving circuit driving first to Nth scan lines of an electro-optical device having pixels specified by the first to Nth scan lines and first to Mth signal lines, the first to Nth scan lines and the first to Mth signal lines being intersect each other, wherein the scan-driving circuit includes:

a shift register which includes serially connected first to Nth flip-flops provided corresponding to the first to Nth scan lines and sequentially shifts a given pulse signal;

a level converter circuit including first to Nth level shifter circuits which shift voltage levels of output nodes of the first to Nth flip-flops and output signals of the shifted voltage levels; and a scan line drive circuit including first to Nth drive circuits which sequentially drive the first to Nth scan lines corresponding to logic levels of output nodes of the first to Nth level shifter circuits, wherein, when the first to Nth scan lines are divided into blocks each of which includes a plurality of scan lines and selection of a display area or a non-display area is performed in units of the blocks, the method comprises:

sequentially driving scan lines in at least one of the blocks selected for the display area; and simultaneously driving at least part of scan lines in at least one of the blocks selected for a non-display area.

Still another aspect of the present invention relates to a method of scan-driving an electro-optical device having pixels specified by first to Nth scan lines and first to Mth signal lines, the first to Nth scan lines and the first to Mth signal lines being intersect each other, the method comprising:

fixing the polarization inversion signal at one of first and second voltage levels corresponding to drive timing of scan lines in at least one of blocks selected for a non-display area, when polarity of a voltage applied to electro-optical elements corresponding to the pixels is reversed in synchronization with a polarization inversion signal which reverses one of the first and second voltage levels in each frame, and selection of the non-display area is performed in units of the blocks, each including a plurality of scan lines.

DETAILED DESCRIPTION

Figure 1:
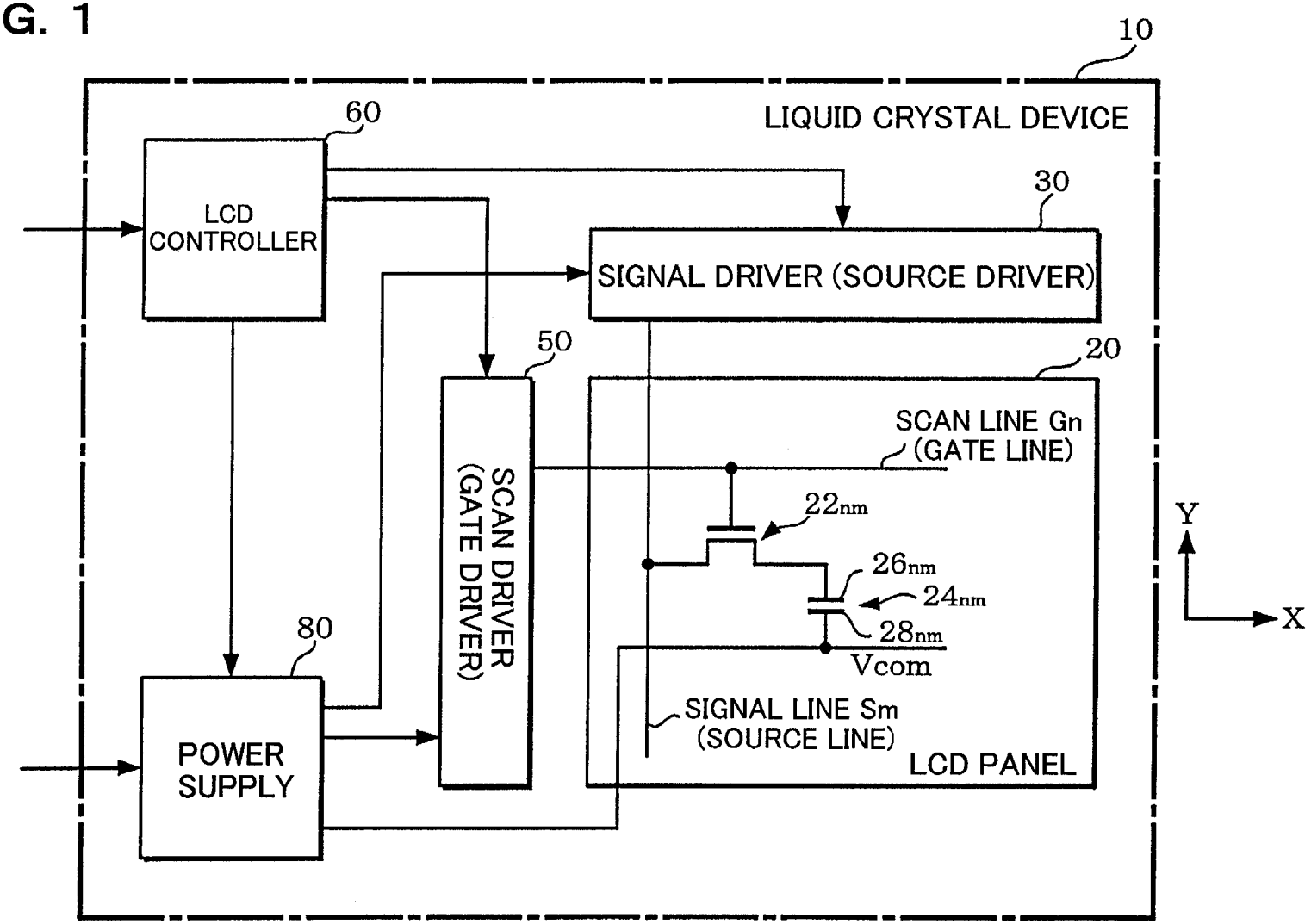
FIG. 1 is a block diagram showing an outline of a configuration of a display device to which a scan-driving circuit (scan driver) of the first embodiment is applied.

Embodiments of the present invention are described below.

Note that the embodiments described hereunder do not in any way limit the scope of the invention defined by the claims laid out herein. Note also that all of the elements of these embodiments should not be taken as essential requirements to the means of the present invention.

An active matrix type liquid crystal panel using a TFT liquid crystal is suitable for displaying a moving image and the like due to high-speed response and high contrast in comparison with a simple matrix type liquid crystal panel using an Super Twisted Nematic (STN) liquid crystal by dynamic driving.

However, since the active matrix type liquid crystal panel using a TFT liquid crystal consumes a large amount of electric power, it is difficult to employ the active matrix type liquid crystal panel as a display section of battery-driven portable electronic equipment such as a portable telephone.

The following embodiments have been achieved in view of the above technical subject. According to the following embodiments, a scan-driving circuit capable of increasing image quality and reducing power consumption and suitable for use in an active matrix type liquid crystal panel, a display device and an electro-optical device using the same, and a scan-driving method can be provided.

One embodiment of the present invention provides a scan-driving circuit which drives first to Nth scan lines (N is a natural number) of an electro-optical device having pixels specified by the first to Nth scan lines and first to Mth signal lines (M is a natural number), the first to Nth scan lines and the first to Mth signal lines being intersect each other, the scan-driving circuit comprising:

a shift register which includes serially connected first to Nth flip-flops provided corresponding to the first to Nth scan lines and sequentially shifts a given pulse signal;

a level converter circuit including first to Nth level shifter circuits which shift voltage levels of output nodes of the first to Nth flip-flops and output signals of the shifted voltage levels; and a scan line drive circuit including first to Nth drive circuits which sequentially drive the first to Nth scan lines corresponding to logic levels of output nodes of the first to Nth level shifter circuits, wherein, when the first to Nth scan lines are divided into blocks each of which includes a plurality of scan lines and selection of a display area or a non-display area is performed in units of the blocks, the scan line drive circuit sequentially drives scan lines in at least one of the blocks selected for the display area, and simultaneously drives at a given drive timing at least part of scan lines in at least one of the blocks selected for a non-display area.

The electro-optical device may comprise first to Nth scan lines and first to Mth signal lines, the first to Nth scan lines and the first to Mth signal lines being intersect each other, N×M switching circuits connected to the first to Nth scan lines and the first to Mth signal lines, and N×M pixel electrodes connected to the switching circuits, for example.

The scan lines divided in units of blocks may be a plurality of adjacent scan lines or a plurality of optionally selected scan lines.

According to this embodiment, the first to Nth scan lines are divided into blocks of a plurality of scan lines, setting of the display area and the non-display area is performed for each of the blocks, and at least part of the scan lines in a block set for the non-display area is simultaneously driven at a given drive timing. Therefore, the scan lines set for the non-display area can be refreshed in a given cycle. Therefore, partial display control capable of preventing a problem such as a gray display occurring when the scan lines are not driven for a certain period of time due to leakage of TFTs can be performed in an LCD panel using a TFT, for example. This enables a decrease in power consumption of the display device and various types of screen display by the partial display at the same time. In particular, application of the scan-driving circuit to the LCD panel using a TFT enables high quality screen display, whereby image display more valuable as information can be achieved.

The scan-driving circuit may comprise a block select data holding circuit which holds block select data for designating a block in which scan lines are driven, and the scan line drive circuit may drive scan lines in a block designated as a block in which scan lines are driven by the block select data, and may simultaneously drive at least part of scan lines in a block designated as a block in which scan lines are not driven by the block select data at a given drive timing.

The scan-driving circuit may be provided with the block select data holding circuit to hold the block select data which indicates whether or not to drive the scan lines in units of the blocks. This enables to optionally change the block selected by the block select data, whereby dynamically controllable partial display can be easily realized.

The scan-driving circuit may comprise a bypass circuit which outputs one of shift input and shift output to a (P+1)th block based on the block select data set for the Pth block, the shift input being input to a front flip-flop in a Pth block (P is a natural number) which includes at least part of a first to Nth flip-flops which form the shift register, and shift output being output from a last flip-flop in the Pth block.

In this configuration, the bypass circuit is provided so that the shift input to the flip-flop provided corresponding to the scan line in the block designated as the block in which the scan lines are not driven by the block select data is bypassed to the flip-flop provided corresponding to the scan line in the adjacent block. Therefore, since only the scan lines in the block set for the display area are driven, power consumption can be reduced for a period of time for driving the scan lines for the non-display area in a given vertical scanning period.

In the scan-driving circuit, the electro-optical device may comprise pixel electrodes provided corresponding to the pixels through switching circuits connected to the first to Nth scan lines and the first to Mth signal lines, when polarity of a voltage applied to electro-optical elements corresponding to the pixel electrodes is reversed in synchronization with a polarization inversion signal which reverses one of first and second voltage levels in each frame, the scan line drive circuit may drive scan lines in a block designated as a block in which scan lines are driven by the block select data, may simultaneously drive a first group of scan lines among the scan lines in the block designated as a block in which scan lines are not driven by the block select data when the polarization inversion signal is at a first voltage level in a predetermined period which includes the drive timing, and may simultaneously drive a second group of scan lines among the scan lines in the block designated as a block in which scan lines are not driven by the block select data when the polarization inversion signal is at a second voltage level in the predetermined period.

According to this configuration, the first and second groups of the scan lines among the scan lines in the block set for the non-display area are simultaneously driven when the polarization inversion signal is at the first voltage level (voltage level corresponding to logic level "H", for example) and the second voltage level (voltage level corresponding to logic level "L", for example) in the predetermined period which includes the drive timing. Therefore, the scan lines for the non-display area can be refreshed using an inversion drive method such as a line inversion drive method by dividing the adjacent scan lines into different groups in advance, for example. Therefore, in the case of the LCD panel using a TFT, refresh operation corresponding to the line inversion drive method can be performed by driving the signal lines corresponding to the non-display area so that a voltage applied to the liquid crystal capacitances connected to the TFTs are at a given threshold value or less in each refresh timing. This prevents deterioration of the liquid crystal and improves display quality in the case of the LCD panel using a TFT while achieving a decrease in power consumption.

In the scan-driving circuit, the drive timing may be set in a blanking interval in one vertical scanning period.

According to this configuration, since the scan lines for the non-display area can be refreshed in one vertical scanning period, a decrease in the display quality due to an increase in the refresh cycle can be prevented.

In the scanning drive circuit, each of the blocks may correspond to eight scan lines.

According to this configuration, since the display area and the non-display area can be set in a character unit, the partial display control can be simplified and an image by effective partial display can be provided.

Another embodiment of the present invention relates to a display device comprising: an electro-optical device having pixels specified by first to Nth scan lines and a plurality of signal lines, the first to Nth scan lines and the plurality of signal lines being intersect each other; any of the above scan-driving circuits which drives the first to Nth scan lines; and a signal drive circuit which drives the signal lines based on image data.

According to this embodiment, a display device capable of realizing a decrease in power consumption by the partial display control can be provided. For example, high image quality partial display can be realized by applying an active matrix type liquid crystal panel.

Still another embodiment of the present invention relates to an electro-optical device comprising: pixels specified by first to Nth scan lines and a plurality of signal lines, the first to Nth scan lines and the plurality of signal lines being intersect each other; any of the above scan-driving circuits which drives the first to Nth scan lines; and a signal drive circuit which drives the signal lines based on image data.

According to this embodiment, an electro-optical device capable of realizing a decrease in power consumption by the partial display control can be provided. For example, high image quality partial display can be realized by applying the electro-optical device to an active matrix type liquid crystal panel.

Yet still another embodiment of the present invention relates to a method of driving a scan-driving circuit driving first to Nth scan lines of an electro-optical device having pixels specified by the first to Nth scan lines and first to Mth signal lines, the first to Nth scan lines and the first to Mth signal lines being intersect each other, wherein the scan-driving circuit includes:

a shift register which includes serially connected first to Nth flip-flops provided corresponding to the first to Nth scan lines and sequentially shifts a given pulse signal;

a level converter circuit including first to Nth level shifter circuits which shift voltage levels of output nodes of the first to Nth flip-flops and output signals of the shifted voltage levels; and a scan line drive circuit including first to Nth drive circuits which sequentially drive the first to Nth scan lines corresponding to logic levels of output nodes of the first to Nth level shifter circuits, wherein, when the first to Nth scan lines are divided into blocks each of which includes a plurality of scan lines and selection of a display area or a non-display area is performed in units of the blocks, the method comprises:

sequentially driving scan lines in at least one of the blocks selected for the display area; and simultaneously driving at least part of scan lines in at least one of the blocks selected for a non-display area.

According to this embodiment, the first to Nth scan lines are divided into blocks for a plurality of scan lines, setting of the display area and the non-display area is performed for each of the blocks, and at least part of the scan lines in the block set for the non-display area is simultaneously driven at a given drive timing. Therefore, a scan-driving method capable of refreshing the scan lines set for the non-display area at a given drive timing can be provided. Therefore, partial display control capable of preventing a problem such as a gray display occurring when the scan lines are not driven for a certain period of time due to leakage of TFTs can be performed in an LCD panel using a TFT, for example. This enables a decrease in power consumption of the display device and various types of screen displays by the partial display at the same time.

The driving method may comprise:

sequentially driving scan lines in a block designated as a block in which scan lines are driven by block select data which designates a block in which scan lines are driven, and simultaneously driving at least part of scan lines in a block designated as a block in which scan lines are not driven by the block select data at a given drive timing.

In this configuration, since whether or not to drive the scan lines in each block is set in units of the blocks by the block select data, the block for the display area and the non-display area can be optionally changed, whereby dynamically controllable partial display can be easily realized.

In the driving method, the scan-driving circuit may comprise a bypass circuit which outputs one of shift input and shift output to a (P+1) th block based on the block select data set for the Pth block, the shift input being input to a front flip-flop in a Pth block (P is a natural number) which includes at least part of a first to Nth flip-flops which form the shift register, and shift output being output from a last flip-flop in the Pth block, the electro-optical device may comprise pixel electrodes provided corresponding to the pixels through switching circuits connected to the first to Nth scan lines and the first to Mth signal lines, and when polarity of a voltage applied to electro-optical elements corresponding to the pixel electrodes is reversed in synchronization with a polarization inversion signal which reverses one of first and second voltage levels in each frame, the method may further comprise:

sequentially driving scan lines in a block designated as a block in which scan lines are driven by the block select data, and simultaneously driving a first group of scan lines among the scan lines in the block designated as a block in which scan lines are not driven by the block select data when the polarization inversion signal is at a first voltage level in a predetermined period which includes the drive timing, and simultaneously driving a second group of scan lines among the scan lines in the block designated as a block in which scan lines are not driven by the block select data when the polarization inversion signal is at a second voltage level in the predetermined period.

In this configuration, the shift input to the flip-flops provided corresponding to the scan lines in the block designated as the block in which the scan lines are not driven by the block select data is bypassed to the flip-flops provided corresponding to the scan lines in the adjacent block. Therefore, since only the scan lines in the block set for the display area are driven, a scan-driving method capable of reducing power consumption for a period of time for driving the scan lines for the non-display area in a given vertical scanning period can be provided.

In the driving method, the drive timing may be set in a blanking interval in one vertical scanning period.

According to this configuration, since the scan lines for the non-display area can be refreshed in one vertical scanning period cycle, a scan-driving method capable of preventing a decrease in the display quality due to an increase in the refresh cycle can be provided.

In the driving method, each of the blocks may correspond to eight scan lines.

According to this configuration, since the display area and the non-display area can be set in a character unit, a scan-driving method capable of simplifying the partial display control and providing an image by effective partial display can be provided.

Further embodiment of the present invention relates to a method of scan-driving an electro-optical device having pixels specified by first to Nth scan lines and first to Mth signal lines, the first to Nth scan lines and the first to Mth signal lines being intersect each other, the method comprising:

fixing the polarization inversion signal at one of first and second voltage levels corresponding to drive-time of scan lines in at least one of blocks selected for a non-display area, when polarity of a voltage applied to electro-optical elements corresponding to the pixels is reversed in synchronization with a polarization inversion signal which reverses one of the first and second voltage levels in each frame, and selection of the non-display area is performed in units of the blocks, each including a plurality of scan lines.

According to this embodiment, since the polarization inversion signal is fixed at one of the first and second voltage levels in synchronization with the drive timing of the scan lines set for the non-display area, a further decrease in power consumption of the display drive of the electro-optical device can be achieved.

Embodiments of the present invention are described below in detail with reference to the drawings.

1. Display Device

1.1 Configuration

FIG. 1 shows an outline of a configuration of a display device to which a scan-driving circuit (scan driver) of the present embodiment is applied.

A liquid crystal device 10 as the display device includes a liquid crystal display (hereinafter abbreviated as "LCD") panel 20, a signal driver (signal drive circuit) (source driver in a narrow sense) 30, a scan driver (scan-driving circuit) (gate driver in a narrow sense) 50, an LCD controller 60, and a power supply circuit 80.

The LCD panel (electro-optical device in a broad sense) 20 is formed on a glass substrate, for example. A plurality of scan lines (gate lines in a narrow sense) $G_1$ to $G_N$ (N is a natural number of two or more) which are arranged in the Y direction and extend in the X direction, and a plurality of signal lines (source lines in a narrow sense) $S_1$ to $S_M$ (M is a natural number of two or more) which are arranged in the X direction and extend in the Y direction are disposed on the glass substrate. A TFT $\mathbf{22}_{nm}$ (switching circuit in a broad sense) is formed corresponding to the intersection between the scan line $G_n$ ($1 \leqq n \leqq N$, n is a natural number) and the signal line $S_m$ ($1 \leqq m \leqq M$, m is a natural number).

A gate electrode of the TFT $\mathbf{22}_{nm}$ is connected to the scan line $G_n$. A source electrode of the TFT $\mathbf{22}_{nm}$ is connected to the signal line $S_m$. A drain electrode of the TFT $\mathbf{22}_{nm}$ is connected to a pixel electrode $\mathbf{26}_{nm}$ of a liquid crystal capacitance (liquid crystal element in a broad sense) $\mathbf{24}_{nm}$.

The liquid crystal capacitance $\mathbf{24}_{nm}$ is formed by sealing a liquid crystal between the pixel electrode $\mathbf{26}_{nm}$ and a common electrode $\mathbf{28}_{nm}$ opposite thereto. The transmittance of the pixel is changed corresponding to the voltage applied between the electrodes.

A common electrode voltage Vcom generated by the power supply circuit 80 is supplied to the common electrode $\mathbf{28}_{nm}$.

The signal driver 30 drives the signal lines $S_1$ to $S_M$ of the LCD panel 20 based on image data in one horizontal scanning unit.

The scan driver 50 sequentially scans the scan lines $G_1$ to $G_N$ of the LCD panel 20 in one vertical scanning period in synchronization with a horizontal synchronization signal.

The LCD controller 60 controls the signal driver 30, scan driver 50, and power supply circuit 80 according to the content set by a host such as a central processing unit (hereinafter abbreviated as "CPU") (not shown). More specifically, the LCD controller 60 supplies the setting of the operation mode or a vertical synchronization signal or horizontal synchronization signal generated therein to the signal driver 30 and the scan driver 50, for example. The LCD controller 60 supplies polarization inversion timing of the common electrode voltage Vcom to the power supply circuit 80.

The power supply circuit 80 generates a voltage level necessary for driving the liquid crystal of the LCD panel 20 or the common electrode voltage Vcom based on a reference voltage supplied from the outside. These voltage levels are supplied to the signal driver 30, scan driver 50, and LCD panel 20. The common electrode voltage Vcom is supplied to the common electrode provided opposite to the pixel electrode of the TFT of the LCD panel 20.

In the liquid crystal device 10 having the above configuration, the LCD panel 20 is driven by the signal driver 30, scan driver 50, and power supply circuit 80 under the control of the LCD controller 60 based on the image data supplied from the outside.

In FIG. 1, the liquid crystal device 10 includes the LCD controller 60. However, the LCD controller 60 may be provided outside the liquid crystal device 10. The liquid crystal device 10 may include the host together with the LCD controller 60.

Signal Driver

Figure 2:
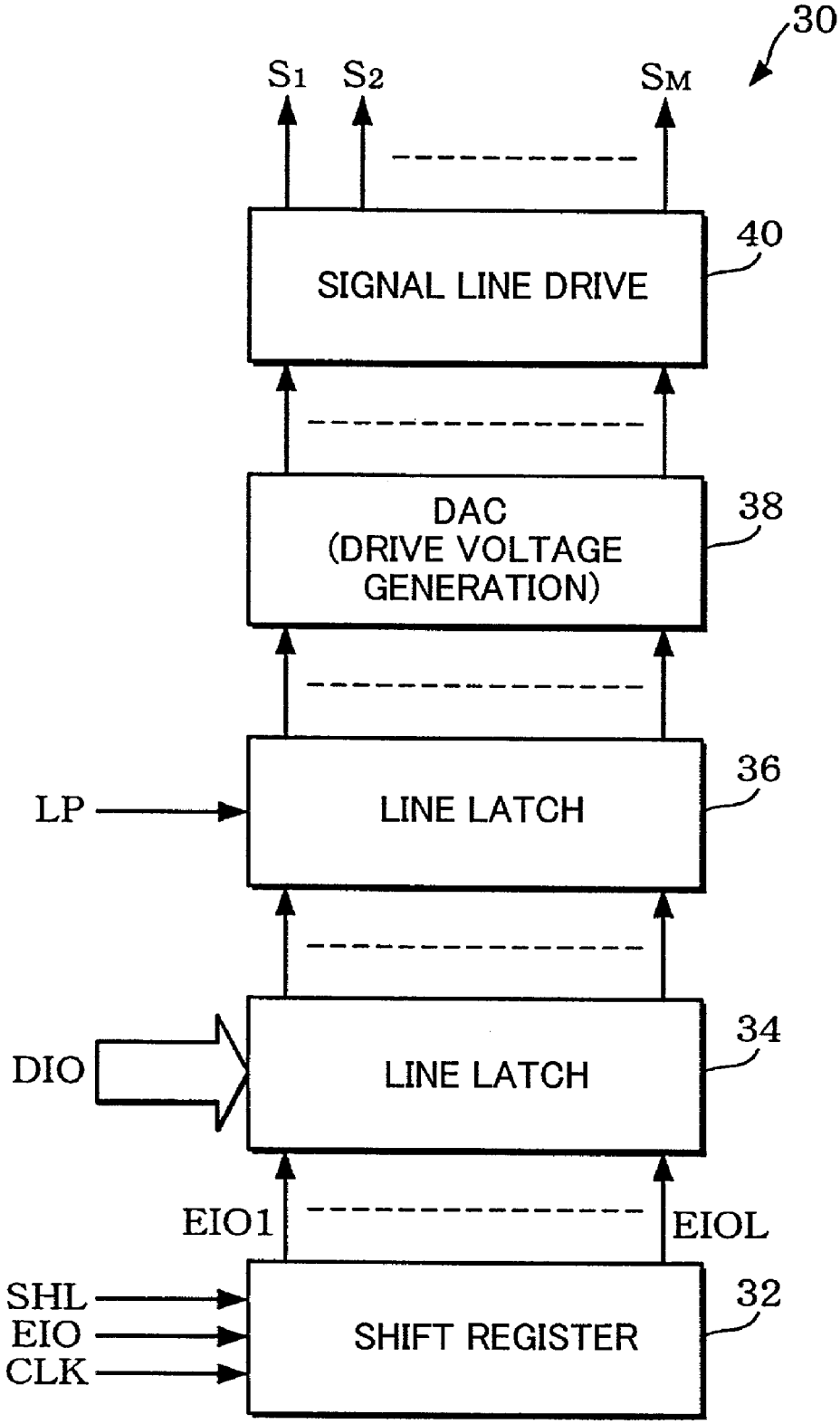
FIG. 2 is a block diagram showing an outline of a configuration of a signal driver shown in FIG. 1.

FIG. 2 shows an outline of a configuration of the signal driver shown in FIG. 1.

The signal driver 30 includes a shift register 32, line latches 34 and 36, a digital-analog converter circuit (drive voltage generation circuit in a broad sense) 38, and a signal line drive circuit 40.

The shift register 32 includes a plurality of flip-flops. These flip-flops are connected sequentially. The shift register 32 holds an enable input/output signal EIO in synchronization with a clock signal CLK, and sequentially shifts the enable input/output signal EIO to the adjacent flip-flop in synchronization with the clock signal CLK.

A shift direction switch signal SHL is supplied to the shift register 32. The shift direction of the image data (DIO) and the input/output direction of the enable input/output signal EIO of the shift register 32 are switched by the shift direction switch signal SHL. Therefore, even if the position of the LCD controller 60 which supplies the image data to the signal driver 30 differs depending upon the mounting conditions of the signal driver 30, flexible mounting can be achieved without increasing the mounting area due to routing of interconnects by switching the shift direction using the shift direction switch signal SHL.

The image data (DIO) is input to the line latch 34 from the LCD controller 60 in a unit of 18 bits (6 bits (gradation data)×3 (RGB)), for example. The line latch 34 latches the image data (DIO) in synchronization with the enable input/output signal EIO sequentially shifted by the flip-flops of the shift register 32.

The line latch 36 latches the image data (DIO) in one horizontal scanning unit latched by the line latch 34 in synchronization with the horizontal synchronization signal LP supplied from the LCD controller 60.

The DAC 38 generates the drive voltage converted into analog based on the image data for each signal line.

The signal line drive circuit 40 drives the signal lines based on the drive voltage generated by the DAC 38.

The signal driver 30 sequentially captures a given unit (18-bit unit, for example) of image data input from the LCD controller 60, and sequentially holds the image data in one horizontal scanning unit in the line latch 36 in synchronization with the horizontal synchronization signal LP. The signal driver 30 drives each signal line based on the image data. As a result, the drive voltage based on the image data is supplied to the source electrode of the TFT of the LCD panel 20.

Scan Driver

Figure 3:
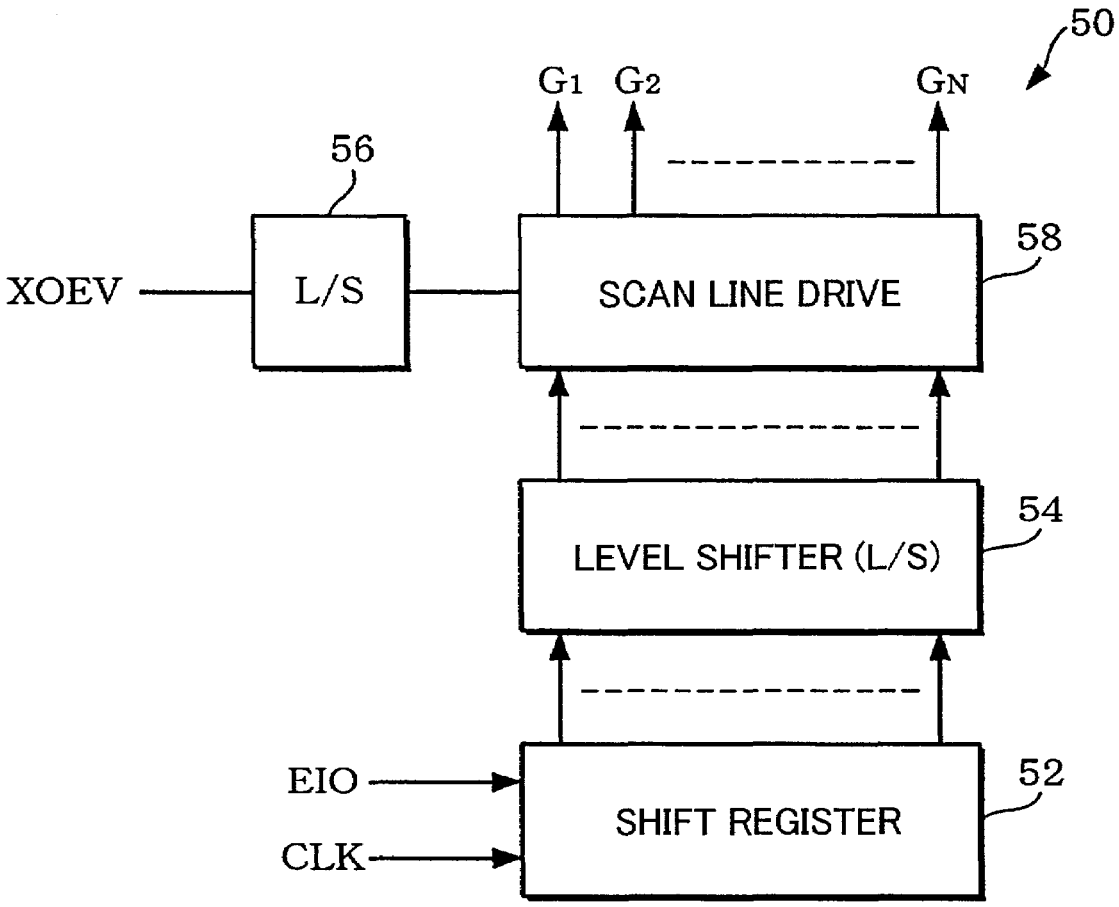
FIG. 3 is a block diagram showing an outline of a configuration of the scan driver shown in FIG. 1.

FIG. 3 shows an outline of a configuration of the scan driver shown in FIG. 1.

The scan driver 50 includes a shift register 52, level shifters (hereinafter abbreviated as "L/S") 54 and 56, and a scan line drive circuit 58.

In the shift register 52, flip-flops provided corresponding to each scan line are connected sequentially. The shift register 52 holds the enable input/output signal EIO in the flip-flop in synchronization with the clock signal CLK, and sequentially shifts the enable input/output signal EIO to the adjacent flip-flop in synchronization with the clock signal CLK. The enable input/output signal EIO input to the shift register 52 is a vertical synchronization signal supplied from the LCD controller 60.

The L/S 54 shifts the voltage level to a level corresponding to the liquid crystal material for the LCD panel 20 and transistor performance of the TFT. Since a high voltage level of 20 V to 50 V is necessary for this voltage level, a high breakdown voltage process differing from that of other logic circuit sections is used.

The scan line drive circuit 58 performs CMOS drive based on the drive voltage shifted by the L/S 54. The scan driver 50 includes the L/S 56 which shifts the voltage level of an output enable signal XOEV supplied from the LCD controller 60. The scan line drive circuit 58 is ON-OFF controlled by the output enable signal XOEV shifted by the L/S 56.

In the scan driver 50, the enable input/output signal EIO input as the vertical synchronization signal is sequentially shifted to each of the flip-flops of the shift register 52 in synchronization with the clock signal CLK. Since each of the flip-flops of the shift register 52 is provided corresponding to each scan line, the scan line is selectively and sequentially selected by a pulse of the vertical synchronization signal held by each of the flip-flops. The selected scan line is driven by the scan line drive circuit 58 at a voltage level shifted by the L/S 54. This allows a given scanning voltage to be supplied to the gate electrode of the TFT of the LCD panel 20 at one vertical scanning cycle. At this time, the potential of the drain electrode of the TFT of the LCD panel 20 is almost equal to the potential of the signal line connected to the source electrode.

LCD Controller

Figure 4:
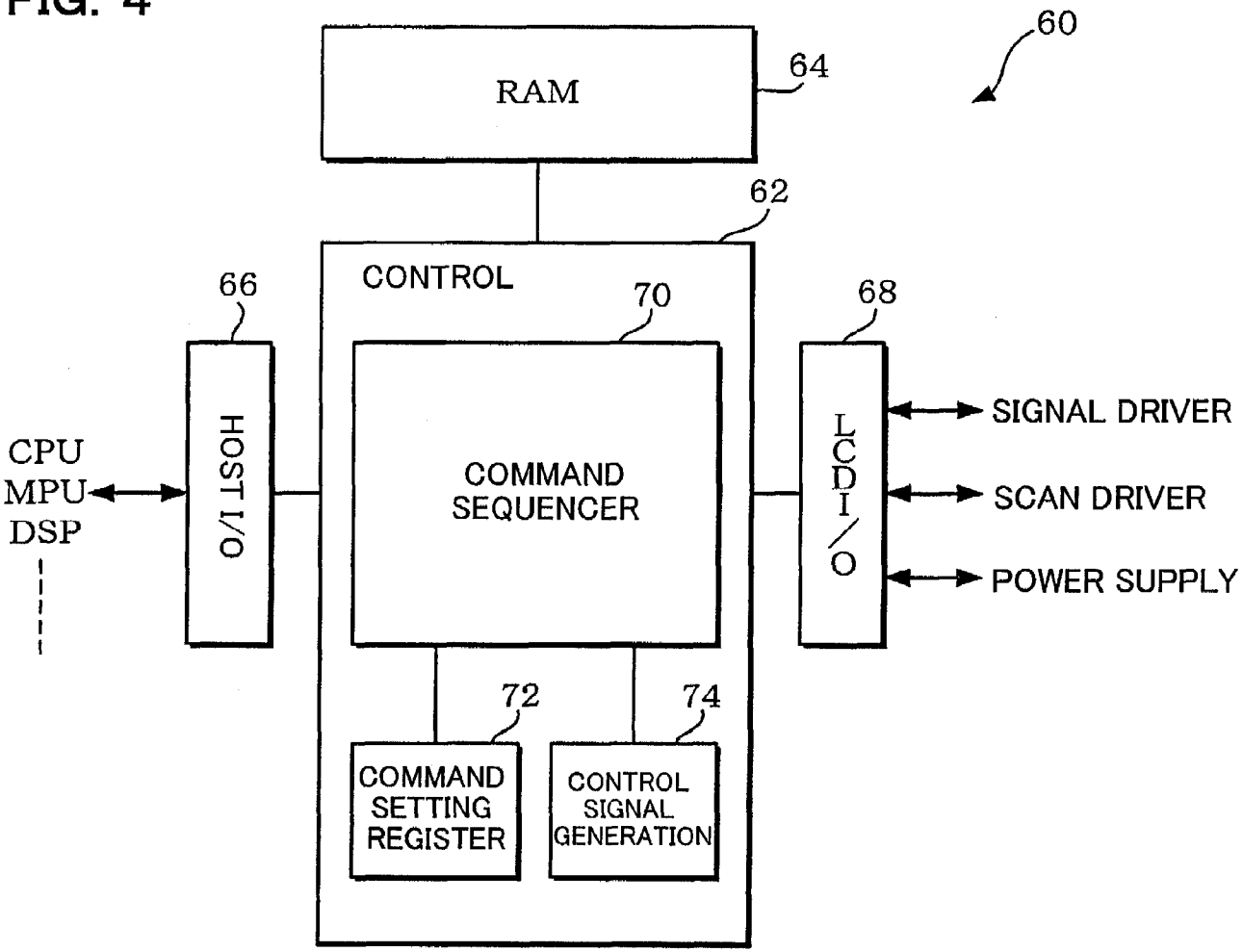
FIG. 4 is a block diagram showing an outline of a configuration of an LCD controller shown in FIG. 1.

FIG. 4 shows an outline of a configuration of the LCD controller shown in FIG. 1.

The LCD controller 60 includes a control circuit 62, a random access memory (hereinafter abbreviated as "RAM") (memory circuit in a broad sense) 64, a host input/output circuit (I/O) 66, and an LCD input/output circuit 68. The control circuit 62 includes a command sequencer 70, a command setting register 72, and a control signal generation circuit 74.

The control circuit 62 sets various types of operation modes and synchronization control of the signal driver 30, scan driver 50, and power supply circuit 80 according to the content set by the host. More specifically, the command sequencer 70 generates synchronization timing using the control signal generation circuit 74 or sets a given operation mode of the signal driver based on the content set in the command setting register 72 according to instructions from the host.

The RAM 64 functions as a frame buffer for displaying the image and as a work area of the control circuit 62.

Image data and command data for controlling the signal driver 30 and the scan driver 50 are supplied to the LCD controller 60 through the host I/O 66. The host I/O 66 is connected with a CPU, a digital signal processor (DSP), or a micro processor unit (MPU) (not shown).

Still image data from the CPU (not shown) or moving image data from the DSP or MPU is supplied to the LCD controller 60 as the image data. The content of the register for controlling the signal driver 30 or scan driver 50, or data for setting various types of operation modes is supplied to the LCD controller 60 as the command data from the CPU (not shown).

The image data and the command data may be supplied through different data buses, or the data bus may be shared. In the latter case, the image data and the command data can be easily shared by enabling the data on the data bus to be identified as either the image data or command data by the signal level input to a command (CMD) terminal, for example. This enables the mounting area to be reduced.

When the image data is supplied to the LCD controller 60, the LCD controller 60 holds this image data in the RAM 64 as a frame buffer. When the command data is supplied to the LCD controller 60, the LCD controller 60 holds the command data in the command setting register 72 or in the RAM 64.

The command sequencer 70 generates various types of timing signals by the control signal generation circuit 74 according to the content of the command setting register 72. The command sequencer 70 sets the mode of the signal driver 30, scan driver 50, or power supply circuit 80 through the LCD input/output circuit 68 according to the content of the command setting register 72.

The command sequencer 70 generates the image data in a given format from the image data stored in the RAM 64 by the display timing generated by the control signal generation circuit 74, and supplies the image data to the signal driver 30 through the LCD input/output circuit 68.

1.2 Inversion Drive Method

In the case of driving a liquid crystal, charges stored in the liquid crystal capacitances must be discharged periodically from the viewpoint of durability of the liquid crystal and the contrast. Therefore, in the liquid crystal device 10, polarity of the voltage applied to the liquid crystal is reversed in a given cycle using AC driving. As the AC drive method, a frame inversion drive method, a line inversion drive method, and the like can be given.

In the frame inversion drive method, polarity of the voltage applied to the liquid crystal capacitances is reversed in each frame. In the line inversion drive method, polarity of the voltage applied to the liquid crystal capacitances is reversed in each line. In the line inversion drive method, polarity of the voltage applied to the liquid crystal capacitances is reversed in each line in a frame cycle.

Figure 5A:
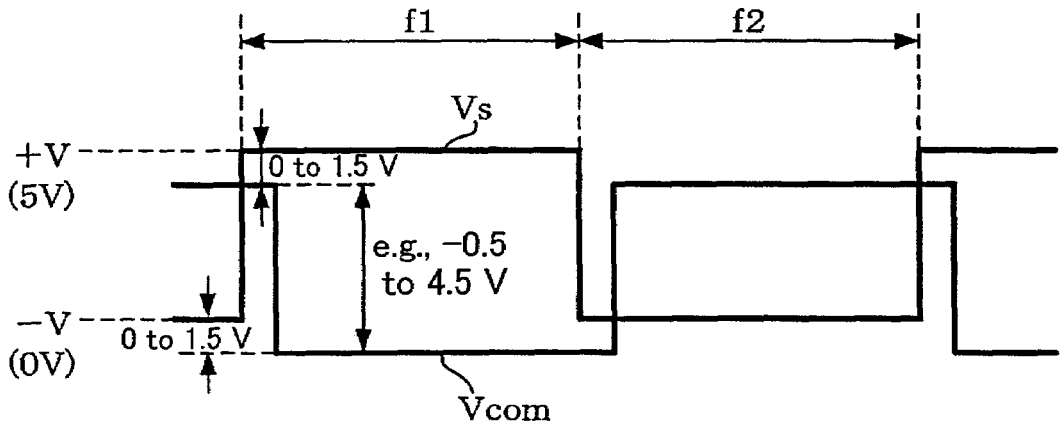
FIG. 5A is a view schematically showing waveforms of a drive voltage of a signal line and a common electrode voltage Vcom by a frame inversion drive method.
Figure 5B:
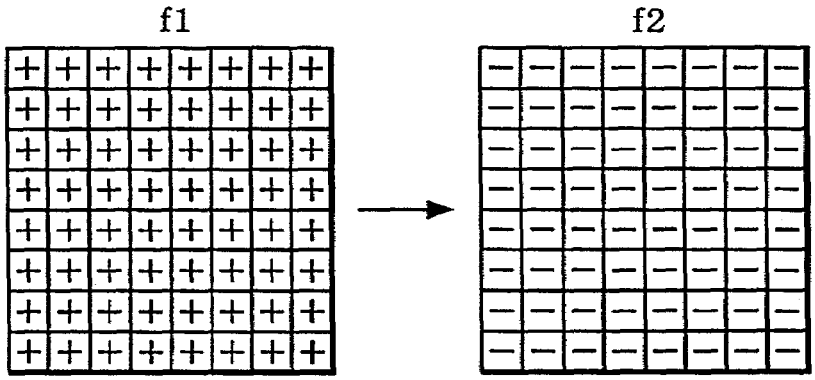
FIG. 5B is a view schematically showing polarity of a voltage applied to liquid crystal capacitances corresponding to each pixel in each frame in the case of utilizing the frame inversion drive method.

FIGS. 5A and 5B are views for describing the operation of the frame inversion drive method. FIG. 5A schematically shows waveforms of the drive voltage of the signal line and the common electrode voltage Vcom using the frame inversion drive method. FIG. 5B schematically shows the polarity of the voltage applied to the liquid crystal capacitances corresponding to each pixel in each frame in the case of using the frame inversion drive method.

In the frame inversion drive method, the polarity of the drive voltage applied to the signal lines is reversed in a frame cycle, as shown in FIG. 5A. Specifically, a voltage $V_S$ supplied to the source electrodes of the TFTs connected to the signal lines is positive (+V) in a frame f1 and negative (−V) in a frame f2. The polarity of the common electrode voltage Vcom supplied to the common electrode opposite to the pixel electrode connected to the drain electrode of the TFT is also reversed in synchronization with the polarization inversion cycle of the drive voltage of the signal lines.

Since the difference in the voltage between the pixel electrode and the common electrode is applied to the liquid crystal capacitances, a positive voltage is applied in the frame f1 and a negative voltage is applied in the frame 2, as shown in FIG. 5B.

Figure 6A:
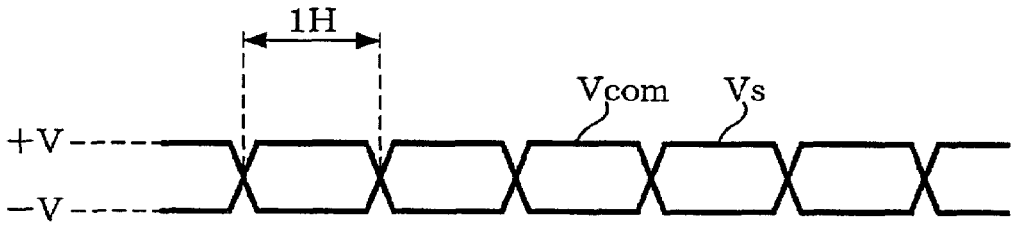
FIG. 6A is a view schematically showing waveforms of the drive voltage of the signal line and the common electrode voltage Vcom by a line inversion drive method.
Figure 6B:
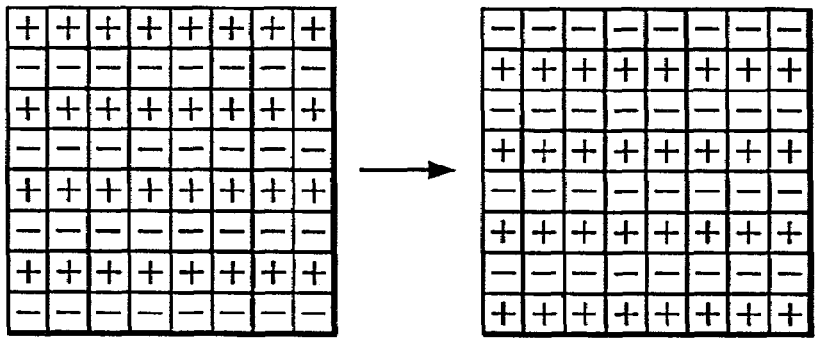
FIG. 6B is a view schematically showing polarity of a voltage applied to liquid crystal capacitances corresponding to each pixel in each frame in the case of utilizing the line inversion drive method.

FIGS. 6A and 6B are views for describing the operation of the line inversion drive method.

FIG. 6A schematically shows the waveforms of the drive voltage of the signal lines and the common electrode voltage Vcom using the line inversion drive method. FIG. 6B schematically shows the polarity of the voltage applied to the liquid crystal capacitances corresponding to each pixel in each line in the case of performing the line inversion drive method.

In the line inversion drive method, the polarity of the drive voltage applied to the signal lines is reversed in one horizontal scanning cycle (1H) and in one frame cycle, as shown in FIG. 6A. Specifically, the voltage $V_S$ supplied to the source electrodes of the TFTs connected to the signal lines is positive (+V) at 1H and negative (−V) at 2H in the frame f1. The voltage $V_S$ is negative (−V) at the 1H and positive (+V) at the 2H in the frame f2.

The polarity of the common electrode voltage Vcom supplied to the common electrode opposite to the pixel electrode connected to the drain electrode of the TFT is also reversed in synchronization with the polarization inversion cycle of the drive voltage of the signal lines.

Since the difference in the voltage between the pixel electrode and the common electrode is applied to the liquid crystal capacitances, a voltage of which the polarity is reversed in each line is applied in the frame cycle by reversing the polarity in each scan line, as shown in FIG. 6B.

Generally, the line inversion drive method contributes to improvement of the image quality in comparison with the frame inversion drive method, since the polarity is reversed in one line cycle. However, power consumption is increased in the line inversion drive method.

1.3 Liquid Crystal Drive Waveform

Figure 7:
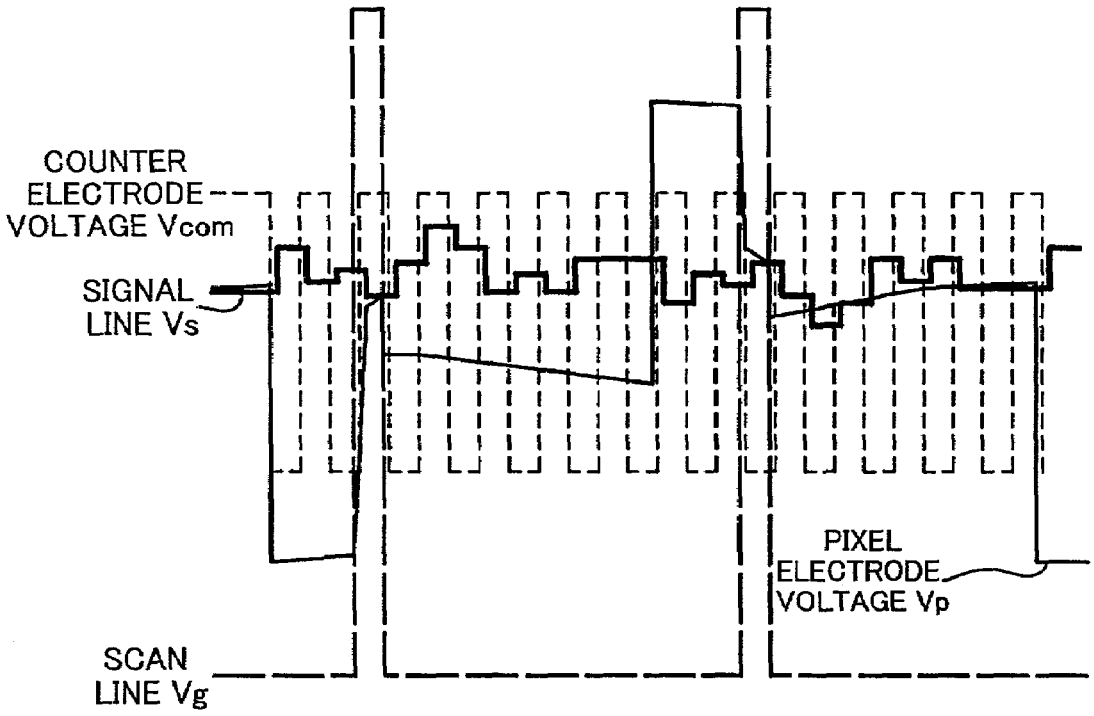
FIG. 7 is an explanatory diagram showing an example of a drive waveform of an LCD panel of a liquid crystal device.

FIG. 7 shows an example of the drive waveform of the LCD panel 20 of the liquid crystal device 10 having the above configuration. This example shows a case of driving the liquid crystal using the line inversion drive method.

In the liquid crystal device 10, the signal driver 30, scan driver 50, and power supply circuit 80 are controlled according to the display timing generated by the LCD controller 60. The LCD controller 60 sequentially transfers the image data in one horizontal scanning unit to the signal driver 30, and supplies the horizontal synchronization signal or polarization inversion signal POL which indicates an inversion drive timing generated therein. The LCD controller 60 supplies the vertical synchronization signal generated therein to the scan driver 50. The LCD controller 60 supplies a common electrode voltage polarization inversion signal VCOM to the power supply circuit 80.

The signal driver 30 drives the signal lines based on the image data in one horizontal scanning unit in synchronization with the horizontal synchronization signal. The scan driver 50 sequentially scans the scan lines connected to the gate electrodes of the TFTs disposed on the LCD panel 20 in a matrix by the drive voltage Vg when triggered by the vertical synchronization signal. The power supply circuit 80 supplies the common electrode voltage Vcom generated therein to each common electrode of the LCD panel 20 while reversing the polarity in synchronization with the common electrode voltage inversion signal VCOM.

Charges corresponding to the difference between the voltage of the pixel electrode connected to the drain electrode of the TFT and the common electrode voltage Vcom are charged in the electrode liquid crystal capacitances. Therefore, an image can be displayed when the pixel electrode voltage Vp held by the charges stored in the liquid crystal capacitances exceeds a given threshold value $V_{CL}$. When the pixel electrode voltage Vp exceeds the given threshold value $V_{CL}$, the transmittance of the pixel is changed corresponding to the voltage level, thereby enabling a gradational display.

2. Scan Driver and Scan-driving Control in First Embodiment 2.1 Scan-driving Control in Block Unit The scan driver 50 enables a partial display by sequentially driving the scan lines designated in units of the blocks divided for a given number of scan lines.

More specifically, the scan driver 50 sequentially drives the scan lines corresponding to the display area set in units of the blocks, but does not drive the scan lines corresponding to the non-display area set in units of the blocks. This enables unnecessary driving in the non-display area to be omitted, whereby power consumption can be reduced. Therefore, use of an active matrix type liquid crystal panel using a TFT capable of improving the image quality in battery-driven electronic equipment enables the electronic equipment to be used for a long period of time in comparison with conventional cases.

In the present embodiment, the block is in a unit of eight scan lines. This enables the display area of the LCD panel 20 to be set in a character (one byte) unit, whereby efficient setting of the display area and display of the image can be achieved in electronic equipment which displays characters, such as in portable telephones.

Figure 8A:
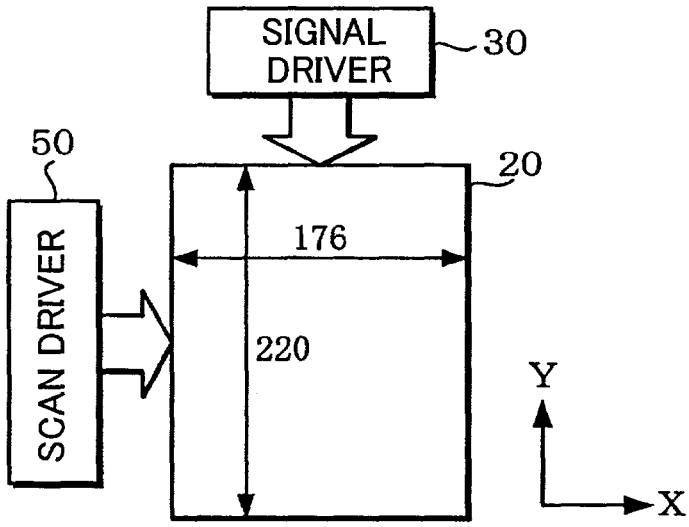
FIGS. 8A, 8B, and 8C are explanatory diagrams schematically showing an example of a partial display realized by the scan driver of the first embodiment.
Figure 8B:
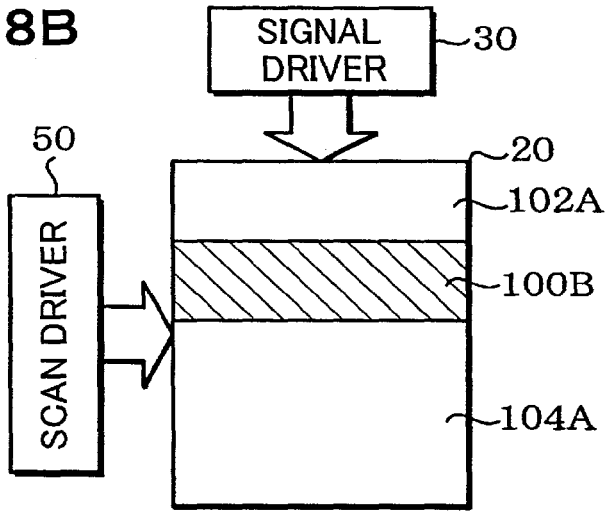
Figure 8C:
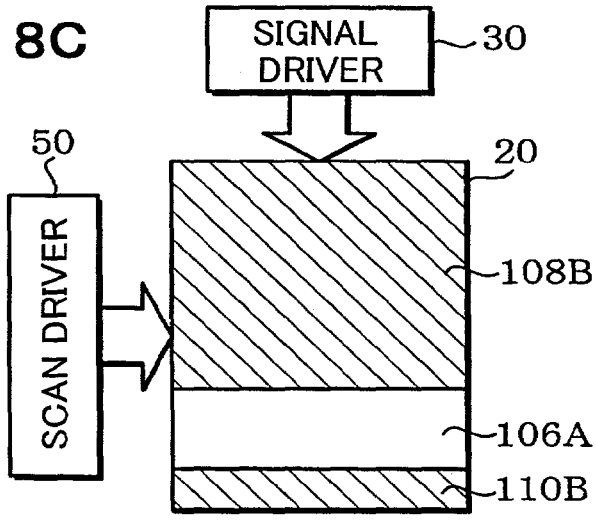

FIGS. 8A, 8B, and 8C are views schematically showing an example of a partial display realized by the scan driver.

As shown in FIG. 8A, in the case where the signal driver 30 is disposed so that a plurality of signal lines is arranged in the Y direction, and the scan driver 50 is disposed so that a plurality of scan lines is arranged in the X direction, a non-display area 100B of the LCD panel 20 is set in units of the blocks as shown in FIG. 8B. This enables only the scan lines in the blocks corresponding to display areas 102A and 104A to be sequentially driven.

In the case where a display area 106A is set in units of the blocks as shown in FIG. 8C, the scan lines in the blocks corresponding to non-display areas 108B and 110B need not be driven. In FIGS. 8B and 8C, a plurality of non-display areas or a plurality of display areas may be provided.

Figure 9A:
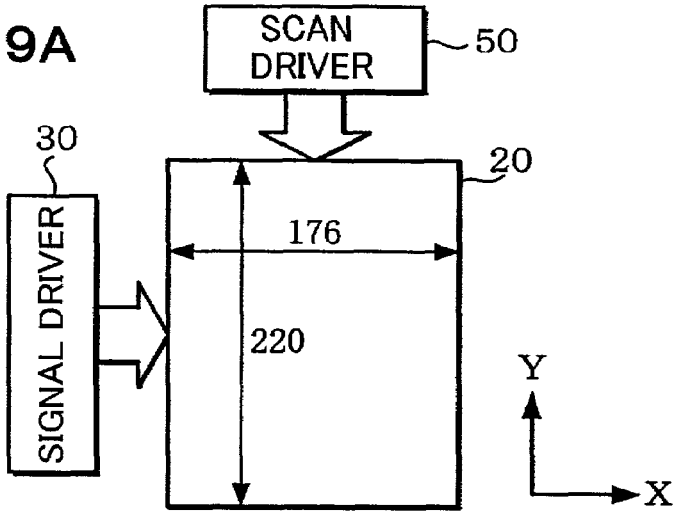
FIGS. 9A, 9B, and 9C are explanatory diagrams schematically showing an example of a partial display realized by the scan driver of the first embodiment.
Figure 9B:
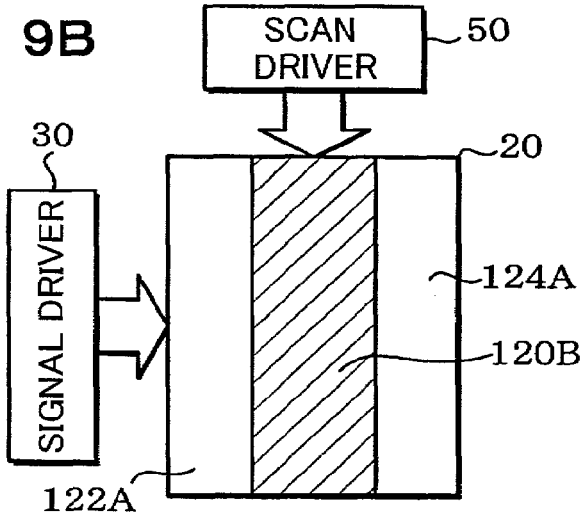
Figure 9C:
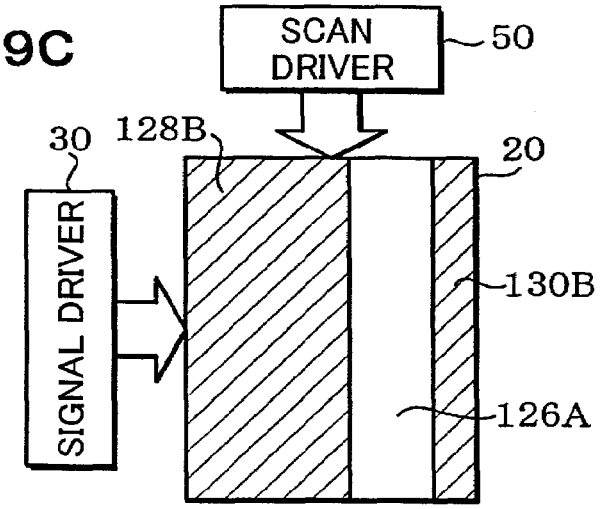

FIGS. 9A, 9B, and 9C are views schematically showing another example of the partial display realized by the scan driver.

As shown in FIG. 9A, in the case where the signal driver 30 is disposed so that a plurality of signal lines is arranged in the X direction and the scan driver 50 is disposed so that a plurality of scan lines is arranged in the Y direction, only the scan lines in the blocks corresponding to display areas 122A and 124A are driven by setting a non-display area 120B of the LCD panel 20 in units of the blocks as shown in FIG. 9B.

In the case where a display area 126A is set in units of the blocks as shown in FIG. 9C, the scan lines in the blocks corresponding to non-display areas 128B and 130B need not be driven. In FIGS. 9B and 9C, a plurality of non-display areas or a plurality of display areas may be provided.

Each of the display areas may be divided into a still image display area and a moving image display area, for example. This enables the provision of a screen convenient for the user and a decrease in the power consumption.

2.2 Data Bypass

The scan driver 50 shifts the enable input/output signal EIO input as the vertical synchronization signal, thereby sequentially driving the scan lines. The scan driver 50 includes a data shift circuit as a bypass circuit which bypasses the block designated as a block which is not driven, and sequentially shifts the signal to the adjacent block. This allows the enable input/output signal EIO to be shifted for the scan lines set for the display area. Therefore, nodes are not changed in the block set for the non-display area, whereby power consumption can be reduced.

Figure 10A:
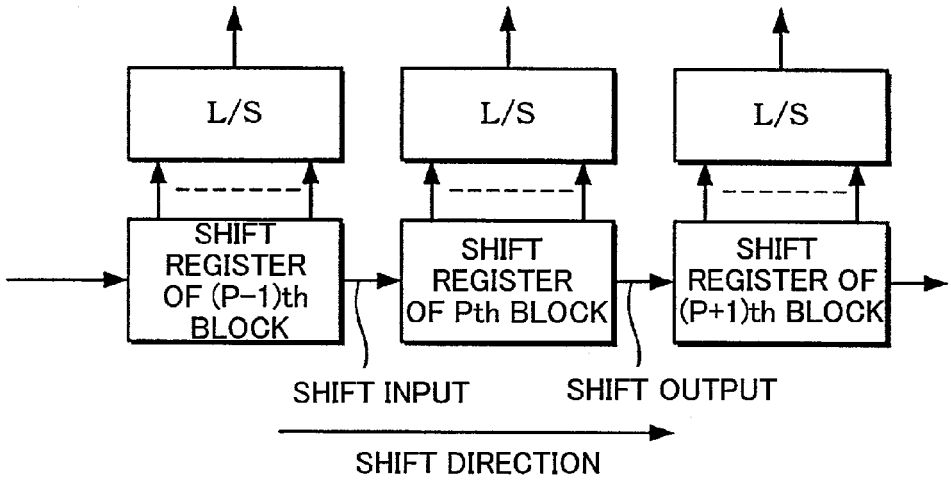
FIGS. 10A and 10B are explanatory diagrams showing an example of data bypass operation of the scan driver of the first embodiment.
Figure 10B:
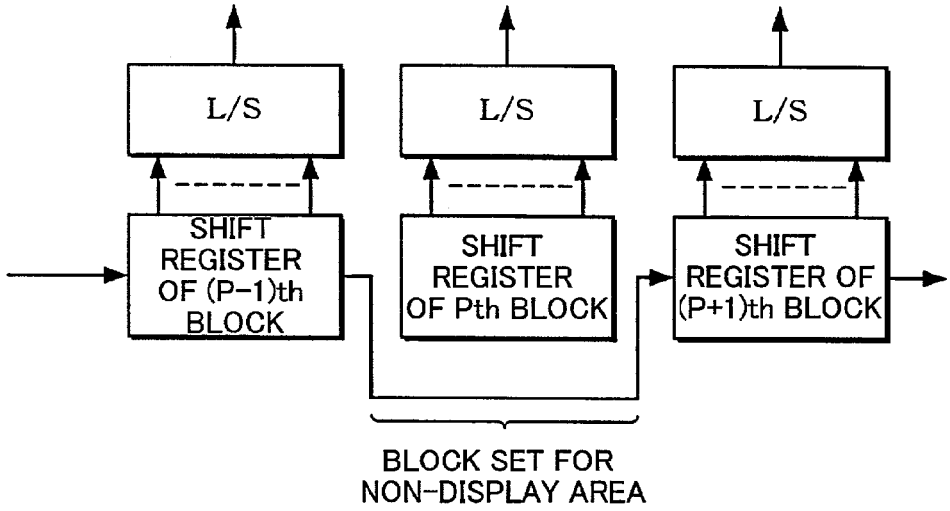

FIGS. 10A and 10B are views showing an outline of the operation of the data shift circuit.

Among the first to Qth blocks divided for a given number of scan lines, the data shift circuit provided corresponding to the Pth block ($1 \leqq P \leqq Q-1$, P is a natural number) designated by the block select data to drive the scan lines sequentially shifts the shift input from the FF in the final stage in the (P−1)th block and supplies the shift output to the (P+1)th block, as shown in FIG. 10A. This allows the scan lines in the Pth block to be driven based on the shift output of the FF which makes up the shift register of the Pth block.

When designated by the block select data to not drive the scan lines, the data shift circuit provided corresponding to the Pth block supplies the shift input to the FF in the first stage in the Pth block to the (P+1)th block among the shift input to the FF in the first stage in the Pth block and the shift output of the FF in the final stage in the Pth block, as shown in FIG. 10B.

When designated by the block select data to not drive the scan lines in the block B1, the enable input/output signal EIO supplied to an $FF_1$ in the block B0 is shifted by $FF_2$ to $FF_8$ in synchronization with the clock signal CLK, and the shift output of the $FF_8$ is supplied to an $FF_{17}$ in the block B2 by the data shift circuit provided corresponding to the block B1.

The data shift circuits maybe provided on the reverse side for each block in order to enable the shift direction of the enable input/output signal EIO to be switched by the given shift direction switch signal SHL. In this case, the data shift circuits are provided corresponding to the blocks BQ to B1.

Since the shift of the enable input/output signal EIO is bypassed by the block set for the non-display area by providing the data shift circuits, the change of the nodes in the block set for the non-display area can be prevented, whereby the power consumption can be reduced. As a result, a period in which the scan lines are not driven can be provided as a blanking interval in one vertical scanning period.

2.3 Refresh

Partial display control capable of dynamically switching the display has not been performed in the active matrix type liquid crystal panel using a TFT.

In the LCD panel 20, AC driving is performed every 1/60th of a second from the viewpoint of the life of the liquid crystal, for example. Therefore, the polarity of the voltage applied to the liquid crystal capacitances provided corresponding to the pixels is reversed in the LCD panel 20 in synchronization with the polarization inversion signal POL and the common electrode voltage inversion signal VCOM generated by the LCD controller 60.

The polarization inversion signal POL and the common electrode voltage polarization inversion signal VCOM are signals which are changed almost at the same timing. The change timing of these signals is shifted taking into consideration the response of the liquid crystal capacitances. Therefore, in the case where the response rate of the liquid crystal capacitances can be ignored, the polarization inversion signal POL and the common electrode voltage polarization inversion signal VCOM may be handled as the same polarization inversion signal.

Figure 11:
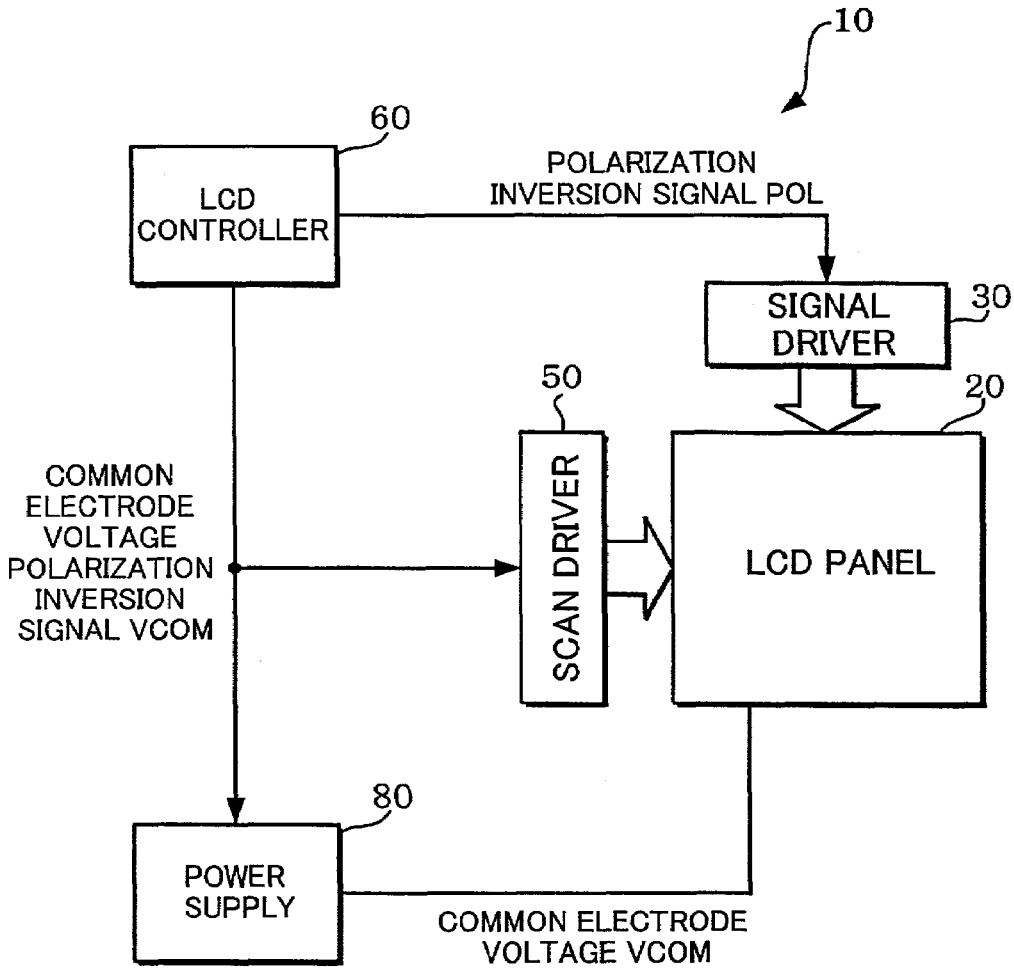
FIG. 11 is an explanatory diagram schematically showing an example of the connection relation between the polarization inversion signal POL and the common electrode voltage polarization inversion signal VCOM in the liquid crystal device.

FIG. 11 schematically shows an example of the connection relation between the polarization inversion signal POL and the common electrode voltage polarization inversion signal VCOM in the liquid crystal device.

The polarization inversion signal POL is generated by the LCD controller 60 and supplied to the signal driver 30. The common electrode voltage polarization inversion signal VCOM is generated by the LCD controller 60 and supplied to at least the power supply circuit 80. In this example, the common electrode voltage polarization inversion signal VCOM is also supplied to the scan driver 50 as described later.

The signal driver 30 changes the voltage level for driving the signal lines in synchronization with the polarization inversion signal POL. The power supply circuit 80 reverses the polarity of the common electrode voltage Vcom applied to the common electrodes opposite to the pixel electrodes provided corresponding to the pixels in synchronization with the common electrode voltage polarization inversion signal VCOM.

Therefore, the frame inversion drive method can be realized by changing the drive voltage level by the polarization inversion signal POL for all the signal lines in each frame, and changing the polarity of the common electrode voltage Vcom by the common electrode voltage polarization inversion signal VCOM, for example. The line inversion drive method can be realized by changing the drive voltage level which is reversed between the adjacent signal lines by the polarization inversion signal POL in each frame, and changing the polarity of the common electrode voltage Vcom by the common electrode voltage polarization inversion signal VCOM, for example.

However, since the liquid crystal deteriorates if the gate electrode is turned ON in a state in which charges are stored in the liquid crystal capacitances, charges stored in the liquid crystal capacitances must be discharged. Therefore, in the active matrix type liquid crystal panel using a TFT, the difference in voltage between the pixel electrodes and the common electrodes of the liquid crystal capacitances is set to 0 in the non-display area.

However, since charges are gradually stored in the liquid crystal capacitance by leakage of the TFTs, charges exceeding the threshold value $V_{CL}$ are stored even if the gate electrode of the TFT is maintained in an OFF state. As a result, the transmittance of the pixels is changed to cause a gray display, for example, whereby a partial display cannot be achieved.

The partial display control method, which can be easily applied to a passive matrix type liquid crystal panel using an STN liquid crystal unless the scan lines are not driven, cannot be directly applied to the active matrix type liquid crystal panel using a TFT. Therefore, in the case of setting the non-display area in the active matrix type liquid crystal panel using a TFT, since the non-display area must be fixed when the power is supplied, partial display control capable of dynamically switching the display cannot be performed.

In the first embodiment, partial display control capable of capable of dynamically switching the display is realized by controlling the voltage of the gate electrode of the TFT. More specifically, partial display control capable of capable of dynamically switching the display is realized by refreshing the liquid crystal capacitances in the non-display area in a given cycle, thereby discharging the stored charges. This enables the amount of electric power consumed by driving the scan lines for the non-display area to be decreased.

Therefore, the common electrode voltage polarization inversion signal VCOM is supplied to the scan driver 50 of the first embodiment as the polarization inversion signal from the LCD controller 60 in order to deal with the above inversion drive method, as shown in FIG. 11. The liquid crystal capacitances are refreshed by controlling the voltage of the gate electrode of the TFTs in synchronization with the common electrode voltage polarization inversion signal VCOM.

2.3.1 Refresh Timing

In the first embodiment, a drive period of the block in which the scan lines are not driven is provided in one vertical scanning period by providing the data shift circuits. Therefore, this period (blanking interval) is used as a refresh timing (non-display area refresh period) for discharging the charges stored in the liquid crystal capacitances of the TFTs connected to the scan lines for the non-display area designated in units of the blocks.

Figure 12:
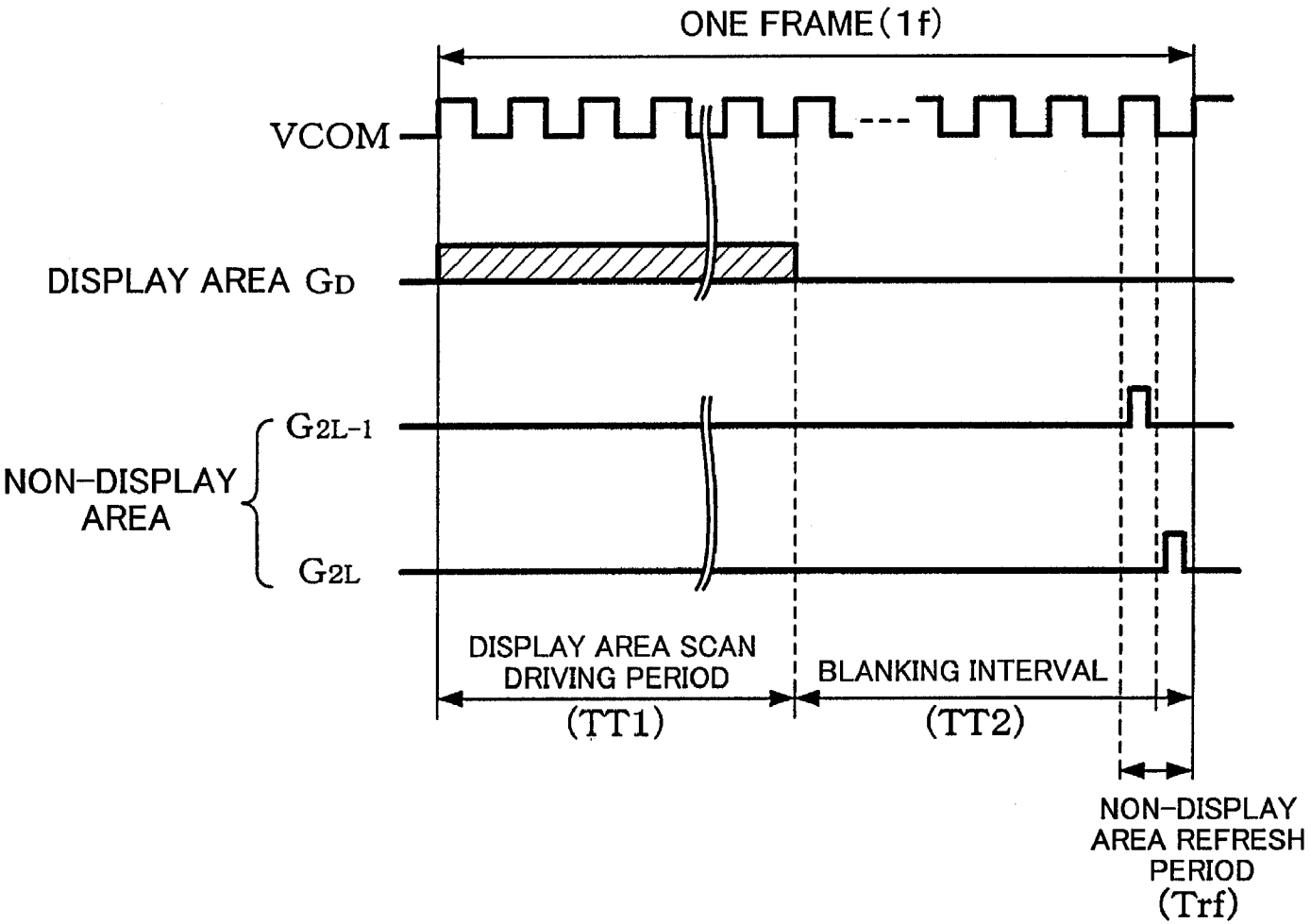
FIG. 12 is an explanatory diagram schematically showing an example of various timings in the vertical scanning period in the case where the scan driver of the first embodiment drives the scan lines using the line inversion drive method.

FIG. 12 shows an example of various timings in one vertical scanning period in the case where the scan driver of the first embodiment drives the scan lines using the line inversion drive method.

The scan driver 50 drives the scan lines for the display area set in units of the blocks. The common electrode voltage polarization inversion signal VCOM of which the logic level is reversed in each scan line is supplied to the LCD panel 20, whereby the line inversion drive is performed.

The scan driver 50 does not drive the scan lines in the block set for the non-display area in units of the blocks by the data shift circuit. Therefore, a blanking interval TT2 follows a display area scan-drive period TT1 after the vertical scanning period (1*f*) is started. The scan driver 50 sequentially drives the scan line ($G_D$) in the block set for the display area during the display area scan-drive period TT1. The scan driver 50 does not drive the scan lines during the blanking interval TT2.

In the first embodiment, the last one cycle of the common electrode voltage polarization inversion signal VCOM in one vertical scanning period (1*f*) is used as a non-display area refresh period Trf. In this period, the even-numbered (odd-numbered) scan lines $G_{2L-1}$ (L is a natural number) in the block set for the non-display area are simultaneously driven when the common electrode voltage polarization inversion signal VCOM is at a first voltage level (logic level "H"). When the common electrode voltage polarization inversion signal VCOM is at a second voltage level (logic level "L"), the odd-numbered (even-numbered) scan lines $G_{2L}$ (L is a natural number) in the block set for the non-display area are simultaneously driven in this period.

In the case of using the frame inversion drive method, if the common electrode voltage polarization inversion signal VCOM is either at the first voltage level or at the second voltage level in the last cycle of the common electrode voltage polarization inversion signal VCOM in one vertical scanning period, all the scan lines in the block set for the non-display area are simultaneously driven.

The common electrode voltage polarization inversion signal VCOM of which the logic level is reversed is supplied to the scan driver 50 in the next frame, whereby each scan line is driven.

This enables the charges stored in the liquid crystal capacitances connected to the scan lines set for the non-display area to be discharged at least in a frame cycle. Therefore, a decrease in power consumption and improvement of partial display quality can be achieved at the same time by preventing the occurrence of a gray display due to leakage of the TFTs while making use of the advantage from high image quality of the LCD panel using a TFT.

An example of the configuration of the scan driver 50 of the first embodiment is described below.

2.4 Configuration

Figure 13:
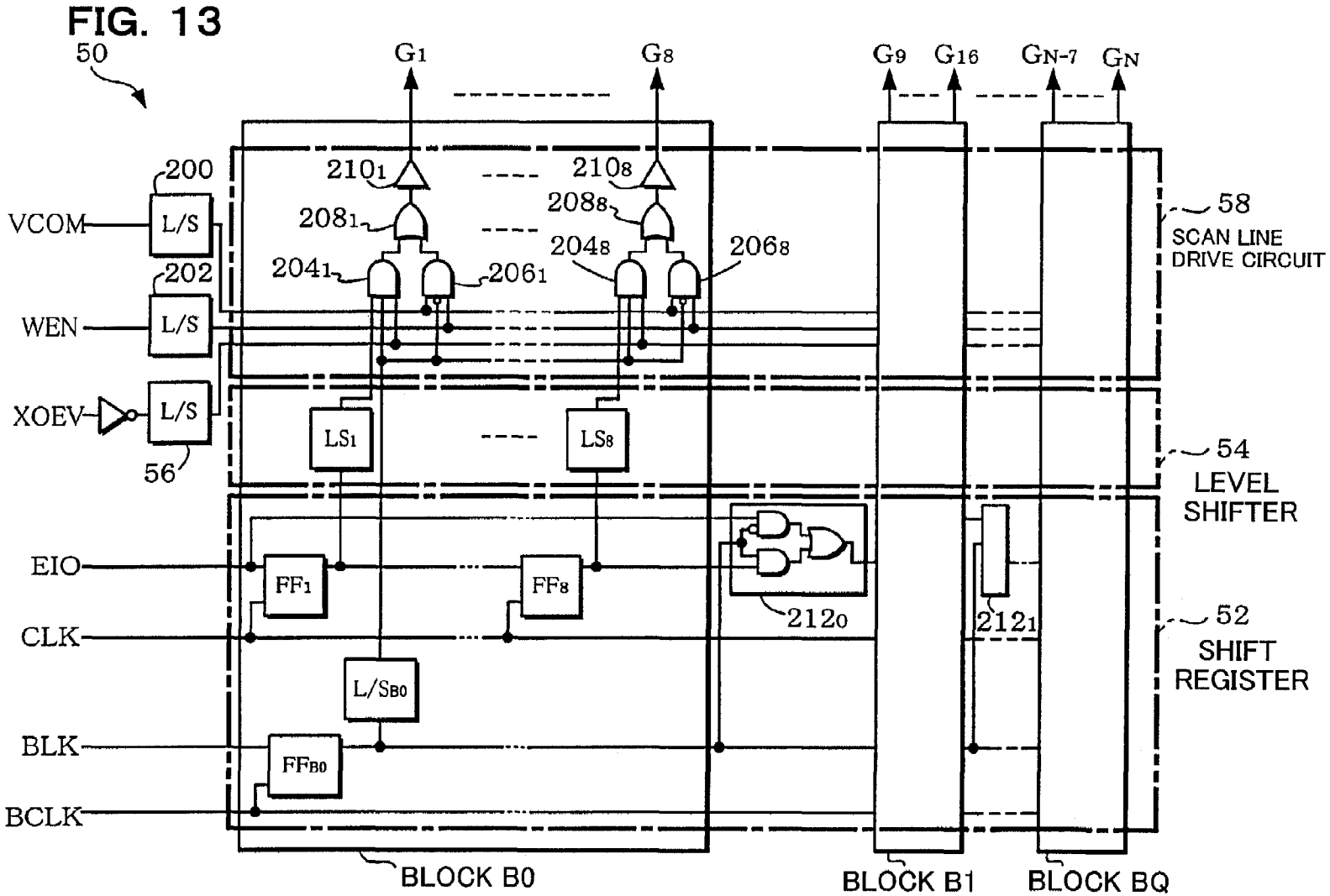
FIG. 13 is a block diagram showing an outline of the configuration of the scan driver of the first embodiment.

FIG. 13 shows an example of the configuration of the scan driver of the first embodiment.

The scan driver 50 of the first embodiment includes a shift register 52, L/S 54, 56, 200, and 202, and a scan line drive circuit 58.

In the shift register 52, flip-flops (hereinafter abbreviated as "FF") $FF_1$ to $FF_N$ (first to Nth FFs) provided corresponding to the scan lines $G_1$ to $G_N$ (first to Nth scan lines) are connected in series. The enable input/output signal EIO is supplied to the $FF_1$ (first FF) from the LCD controller 60. The clock signal CLK is supplied to the $FF_1$ to $FF_N$ from the LCD controller 60. Specifically, the $FF_1$ to $FF_N$ sequentially shift the enable input/output signal EIO (given pulse signal) in synchronization with the clock signal CLK.

The enable input/output signal EIO supplied from the LCD controller 60 is a vertical synchronization signal. The clock signal CLK supplied from the LCD controller 60 is a horizontal synchronization signal.

The L/S 54 includes level shifter circuits $LS_1$ to $LS_N$ (first to Nth level shifter circuits) provided corresponding to the scan lines $G_1$ to $G_N$. The level shifter circuits $LS_1$ to $LS_N$ shift the voltage level on the high potential side of the data held by the corresponding $FF_1$ to $FF_N$ to a voltage level of 20 V to 50 V, for example.

The L/S 56 shifts the voltage level on the high potential side of the inversion signal of the output enable signal XOEV supplied from the LCD controller 60 to a voltage level of 20 V to 50 V, for example.

The L/S 200 shifts the voltage level on the high potential side of the common electrode voltage polarization inversion signal VCOM supplied from the LCD controller 60 to a voltage level of 20 V to 50 V, for example.

The L/S 202 shifts the voltage level on the high potential side of a write enable signal WEN supplied from the LCD controller 60 to a voltage level of 20 V to 50 V, for example. The write enable signal WEN causes each scan line for the non-display area to be simultaneously driven in the non-display area refresh period.

The scan line drive circuit 58 includes 3-input 1-output AND circuits $\mathbf{204}_1$ to $\mathbf{204}_N$ and $\mathbf{206}_1$ to $\mathbf{206}_N$, 2-input 1-output OR circuits $\mathbf{208}_1$ to $\mathbf{208}_N$, and CMOS buffer circuits $\mathbf{210}_1$ to $\mathbf{210}_N$ corresponding to each of the scan lines $G_1$ to $G_N$. The 3-input 1-output AND circuits $\mathbf{204}_1$ to $\mathbf{204}_N$ and $\mathbf{206}_1$ to $\mathbf{206}_N$, 2-input 1-output OR circuits $\mathbf{208}_1$ to $\mathbf{208}_N$, and CMOS buffer circuits $\mathbf{210}_1$ to $\mathbf{210}_N$ are formed by a high breakdown voltage process which enables operation at a voltage level of 20 to 50V, for example. This voltage level is determined depending upon the liquid crystal material for the LCD panel 20 to be driven or the like.

The logic level of the data held by the $FF_i$ level-shifted by the $LS_i$, the block select data of the scan line, and the output enable signal XOEV level-shifted by the L/S 56 are supplied to the 3-input 1-output AND circuit $\mathbf{204}_i$ provided corresponding to the scan line $G_i$ ($1 \leqq i \leqq N$, i is a natural number). An output node of the 3-input 1-output AND circuit $\mathbf{204}_i$ is connected to one of the input terminals of the 2-input 1-output OR circuit $\mathbf{208}_i$.

The inversion signal of the block select data of the scan line, the common electrode voltage polarization inversion signal VCOM level-shifted by the L/S 200, and the write enable signal WEN level-shifted by the L/S 202 are supplied to the 3-input 1-output AND circuit $\mathbf{206}_i$ provided corresponding to the odd-numbered scan line $G_i$. The inversion signal of the block select data of the scan line, the common electrode voltage polarization inversion signal VCOM level-shifted by the L/S 200, and the write enable signal WEN level-shifted by the L/S 202 are supplied to the 3-input 1-output AND circuit $\mathbf{206}_i$ provided corresponding to the even-numbered scan line $G_i$.

An output node of the 3-input 1-output AND circuit $\mathbf{206}_i$ is connected to the other input terminal of the 2-input 1-output OR circuit $\mathbf{208}_i$.

An output node of the 2-input 1-output OR circuit $\mathbf{208}_i$ is connected to the input terminal of the CMOS buffer circuit $\mathbf{210}_i$. The CMOS buffer circuit $\mathbf{210}_i$ drives the scan line $G_i$.

The block select data is held by $FF_{B0}$ to $FF_{BQ}$ provided in units of the blocks. The block select data BLK serially input from the LCD controller 60 is supplied to the $FF_{B0}$. A clock signal BCLK for sequentially capturing the serially-input block select data BLK is supplied in common to the $FF_{B0}$ to $FF_{BQ}$ from the LCD controller 60. The $FF_{B0}$ to $FF_{BQ}$ sequentially shift the block select data BLK supplied to the $FF_{B0}$ in synchronization with the clock signal BCLK.

In this scan line drive circuit, when the block select data is set to "0" as the block in the non-display area, the scan line $G_i$ is driven corresponding to the logical product of the common electrode polarization inversion signal VCOM and the write enable signal WEN. At this time, since the common electrode polarization inversion signal VCOM is supplied to the adjacent scan lines in the block in a state in which the polarity is reversed in each line, the odd-numbered scan lines are not driven when the even-numbered scan lines are driven, and the even-numbered scan lines are not driven when the odd-numbered scan lines are driven.

When the block select data is set to "1" as the block for the display area, the scan line $G_i$ is driven corresponding to the logical product of the inversion signal of the output enable signal XOEV and the output node of the $LS_i$.

Specifically, the scan lines in the block set for the display area are driven according to the shift timing of the enable input/output signal EIO which is sequentially shifted in the $FF_1$ to $FF_N$ of the shift register 52. The scan lines in the block set for the non-display area are driven according to the common electrode polarization inversion signal VCOM and the write enable signal WEN supplied from the LCD controller 60.

The scan driver 50 further includes data shift circuits (bypass circuits) $\mathbf{212}_0$ to $\mathbf{212}_{Q-1}$ for bypassing the enable input/output signal EIO in units of the blocks.

When designated by the block select data to not drive the scan lines in the block B1, the enable input/output signal EIO supplied to the $FF_1$ in the block B0 is shifted by the $FF_2$ to $FF_8$ in synchronization with the clock signal CLK. The shift output of the $FF_8$ is supplied to the $FF_{17}$ in the block B2 by the data shift circuit $\mathbf{212}_1$ provided corresponding to the $FF_9$ in the block B1, as shown in FIGS. 10A and 10B.

More specifically, the data shift circuit $\mathbf{212}_0$ provided corresponding to the block B0 shifts the shift output supplied from the block in the previous stage (enable input/output signal EIO supplied to $FF_1$ in block B0) and the shift output of the FF in this block in the final stage (shift output from $FF_8$ in block B0) by the block select data of the block. The output signal shifted by the data shift circuit $\mathbf{212}_0$ is supplied to the block B1.

The data shift circuits may be provided on the reverse side for each block in order to enable the shift direction of the enable input/output signal EIO to be switched by the given shift direction switch signal SHL. In this case, the data shift circuits are provided corresponding to the blocks BQ to B1.

Figure 14:
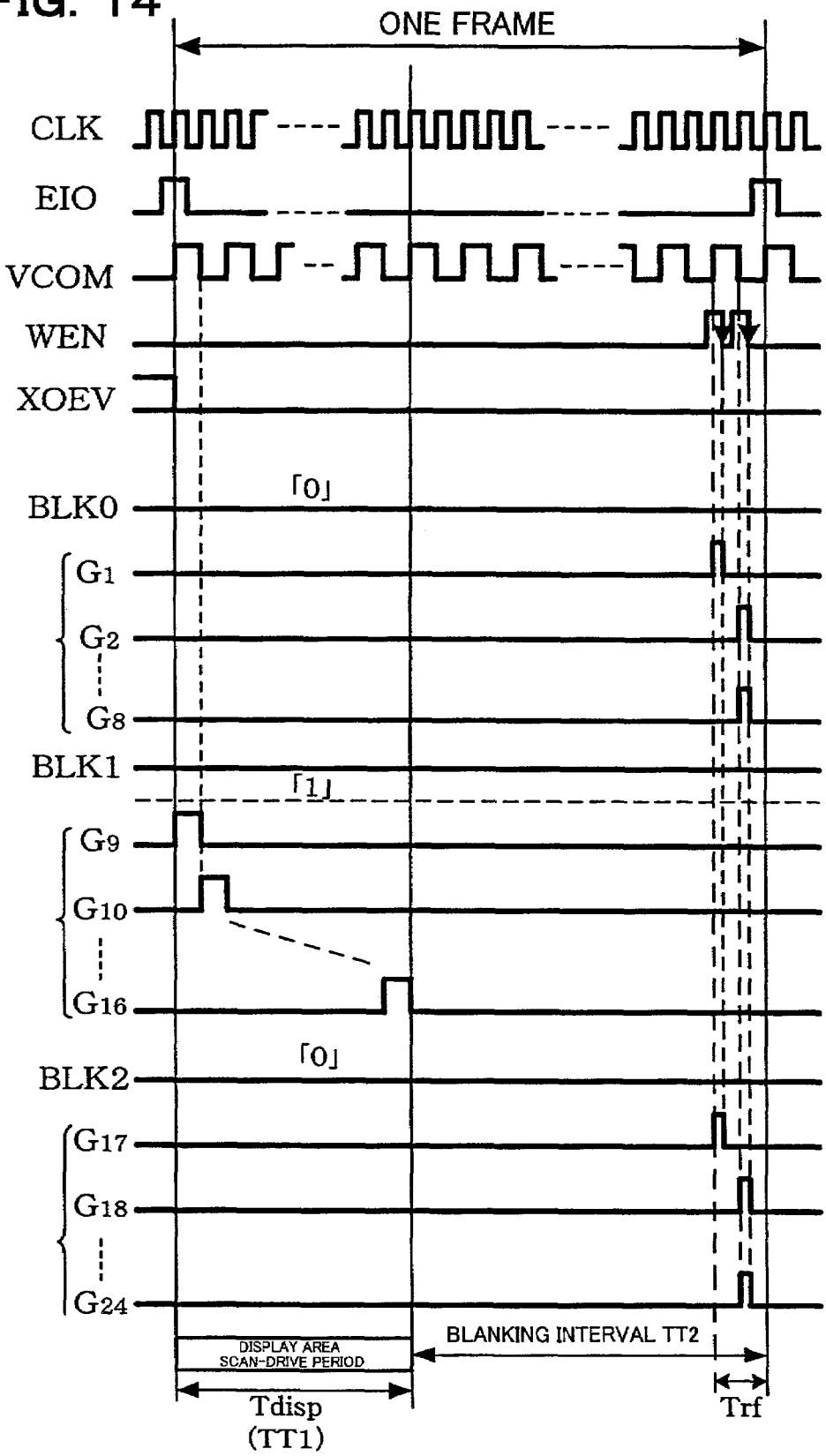
FIG. 14 is a timing chart showing an example of the operation timing of the scan driver of the first embodiment.

FIG. 14 shows an example of the operation timing of the scan driver of the first embodiment.

In this example, the block B1 is set for the display area and other blocks B0, B2, . . . are set for the non-display area. Specifically, the block select data held by the $FF_{B1}$ in the block B1 is "1", and the block select data held by the $FF_{B0}$ in the block B0, $FF_{B2}$ in the block B2, . . . is "0".

The common electrode polarization inversion signal VCOM is input in a state in which the polarity is reversed in one line scanning period.

When the enable input/output signal EIO is supplied as the vertical synchronization signal, the enable input/output signal EIO is bypassed to the block B1 by the data shift circuit $\mathbf{212}_0$, since the block select data in the block B0 is "0".

Therefore, when the logic level of the output enable signal XOEV is "L", the scan lines $G_9$ to $G_{16}$ in the block B1 are sequentially driven from a timing tb1 in synchronization with the clock signal CLK. Since the block select data is "0" in the blocks B2 and B3, the scan lines in these blocks are not driven. Specifically, the scan lines for the display area are driven only in a period Tdisp in one frame cycle T. Therefore, it is unnecessary to drive the scan lines in a period "T-Tdisp" as the blanking interval, whereby the power consumption can be reduced.

In the first embodiment, the scan lines in the block set for the non-display area are simultaneously driven by utilizing the last cycle of the common electrode voltage polarization inversion signal VCOM in one frame. Therefore, the LCD controller 60 supplies a pulse of the write enable signal WEN when the logic level of the common electrode voltage polarization inversion signal VCOM is "H" or "L" in this last cycle.

Therefore, when the logic level of the common electrode voltage polarization inversion signal VCOM is "H", the odd-numbered scan lines among the scan lines in the block set for the non-display area are simultaneously driven. In FIG. 14, the scan lines $G_1$, $G_3$, . . . $G_7$, $G_{17}$, $G_{19}$, . . . in the odd-numbered lines in the blocks B0, B2, . . . are driven.

At this time, a drive voltage which does not cause the difference between the pixel electrode voltage and the common electrode voltage of the liquid crystal of the pixel in the non-display area to exceed the given threshold value $V_{CL}$ is supplied to the corresponding signal line by the signal driver 30. This enables the liquid crystal capacitances connected to the TFTs in the odd-numbered lines in the block set for the non-display area to be refreshed periodically.

When the logic level of the common electrode voltage polarization inversion signal VCOM is "L", the scan lines in the even-numbered lines among the scan lines in the block set for the non-display area are simultaneously driven. In FIG. 14, the scan lines $G_2$, $G_4$, . . . $G_8$, $G_{18}$, $G_{20}$, . . . in the even-numbered lines in the blocks B0, B2 . . . are driven.

At this time, a drive voltage which does not cause the difference between the pixel electrode voltage and the common electrode voltage of the liquid crystal of the pixel in the non-display area to exceed the given threshold value $V_{CL}$ is supplied to the corresponding signal line by the signal driver 30. This enables the liquid crystal capacitances connected to the TFTs in the even-numbered lines in the block set for the non-display area to be refreshed periodically.

This allows only the scan lines for the display area to be driven, whereby the power consumption can be reduced. Moreover, since the charges stored in the liquid crystal capacitances can be discharged by turning ON the gate electrode of the TFTs in one frame cycle, deterioration of the image quality in the non-display area caused by leakage of the TFTs can be prevented.

Modification

Figure 15:
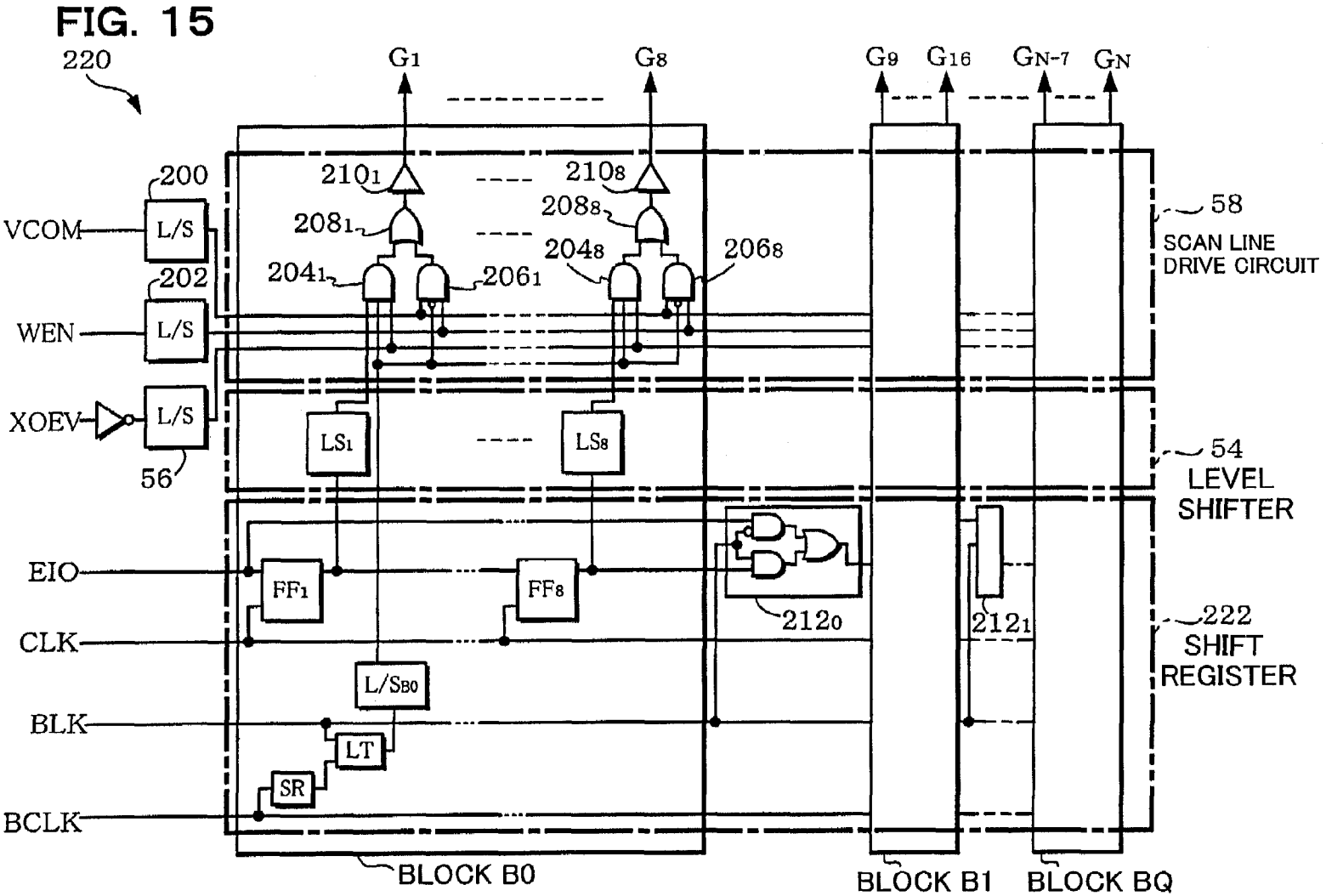
FIG. 15 is a configuration diagram showing a configuration of a modification example of the scan driver of the first embodiment.

FIG. 15 shows a configuration of a modification example of the scan driver of the first embodiment.

In FIG. 15, sections the same as those of the scan driver shown in FIG. 13 are indicated by the same symbols. Description of these sections is appropriately omitted.

The difference between a scan driver 220 of this modification example and the scan driver 50 of the first embodiment is that the block select data BLK is latched in a latch (LT) in a shift register 222 in synchronization with the shift output of the clock signal BCLK. This also enables the above-described drive control to be performed by setting the block select data in units of the blocks.

In the first embodiment, the blanking interval is provided in the last cycle in one frame. However, the present invention is not limited thereto.

3. Scan Driver in Second Embodiment

The scan driver of the first embodiment realizes a decrease in power consumption by the partial display control by changing the configuration of a conventional scan driver. However, a scan driver of the second embodiment realizes a decrease in power consumption by partial display control using a simpler configuration.

The scan driver of the second embodiment performs partial display control in units of the blocks in the same manner as the scan driver of the first embodiment.

3.1 Refresh

As described above, the partial display control method which can be easily applied to a passive matrix type liquid crystal panel using an STN liquid crystal unless the scan lines are not driven cannot be directly applied to the active matrix type liquid crystal panel using a TFT. Therefore, in the case of setting the non-display area in the active matrix type liquid crystal panel using a TFT, since the non-display area is fixed when the power is supplied, partial display control capable of dynamically switching the display cannot be performed.

In the second embodiment, the amount of electric power consumed by driving the scan lines for the non-display area is decreased by the partial display control in units of the blocks. Moreover, refreshing necessary for the LCD panel using a TFT is performed by driving the scan lines set for the display area in units of the blocks in one frame cycle, and driving all the scan lines including the scan line set for the non-display area in units of the blocks in an odd-numbered frame cycle of three frames or more.

Figure 16A:
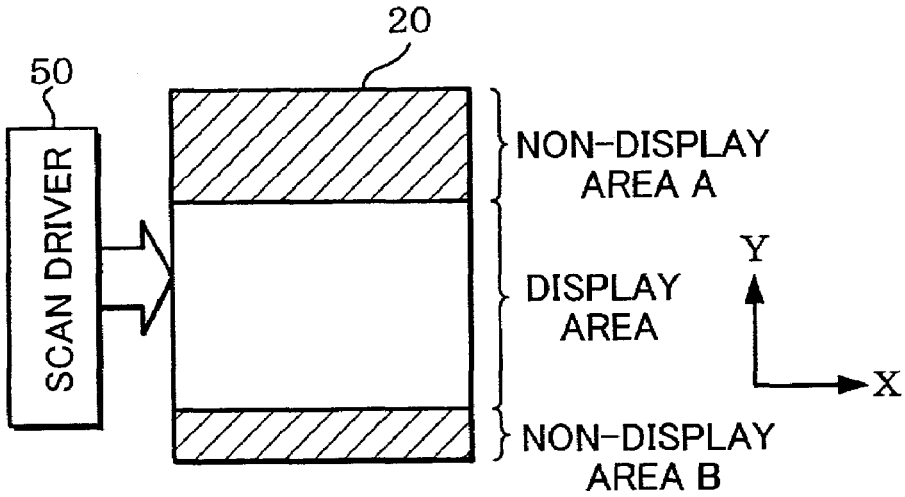
FIGS. 16A and 16B are explanatory diagrams showing an example of the operation of the scan driver of the second embodiment.
Figure 16B:
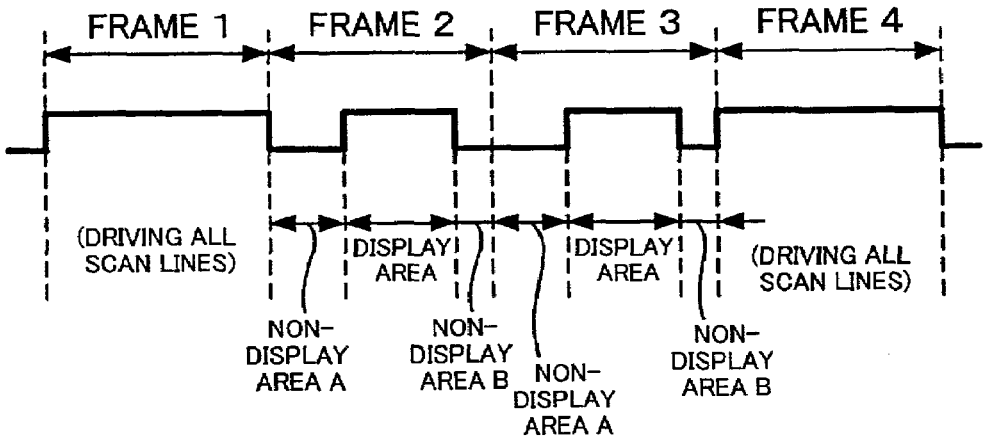

FIGS. 16A and 16B are views showing an example of the operation of the scan driver of the second embodiment.

In this example, in the case where a plurality of scan lines is arranged in the Y direction of the LCD panel 20, a display area and non-display areas A and B are provided in units of the blocks as shown in FIG. 16A.

In the case where all the scan lines in the blocks for the display area and the non-display areas A and B are sequentially driven in the first frame, all the scan lines of the LCD panel 20 are sequentially driven in the fourth frame at an interval of two frames from the first frame as shown in FIG. 16B, for example. Specifically, all the scan lines of the LCD panel 20 are driven in a three frame cycle in FIG. 16B.

In the case where the polarity of the voltage applied to the liquid crystal capacitances is positive in the first frame, the polarity of the voltage applied to the liquid crystal capacitances is negative in the fourth frame and is positive in the seventh frame, whereby the AC driving is realized. Moreover, the scan lines corresponding to the non-display areas A and B are not driven in the second and third frames between the frames in which all the scan lines are driven (first and fourth frames), whereby the power consumption can be reduced.

Therefore, in the case where the AC driving is performed in the active matrix type liquid crystal panel using a TFT in the frame cycle, the polarity of the voltage applied to the liquid crystal capacitances can be reversed and the power consumption can be reduced by eliminating unnecessary driving of the scan lines.

3.2 Operation Control of Polarization Inversion Signal

In the second embodiment, deterioration of the image quality is prevented and the power consumption is reduced by performing the partial display control corresponding to the liquid crystal inversion drive. Moreover, the power consumption is further reduced by terminating the operation of the polarization inversion signals (common electrode voltage polarization inversion signal VCOM and polarization inversion signal POL) shown in FIG. 11 in the scan-drive period of the non-display area.

FIGS. 17A, 17B, 17C, 17D, and 17E are views showing examples of the operation termination timing of the common electrode voltage polarization inversion signal VCOM.

Figures 17A, 17B, 17C, 17D, 17E:
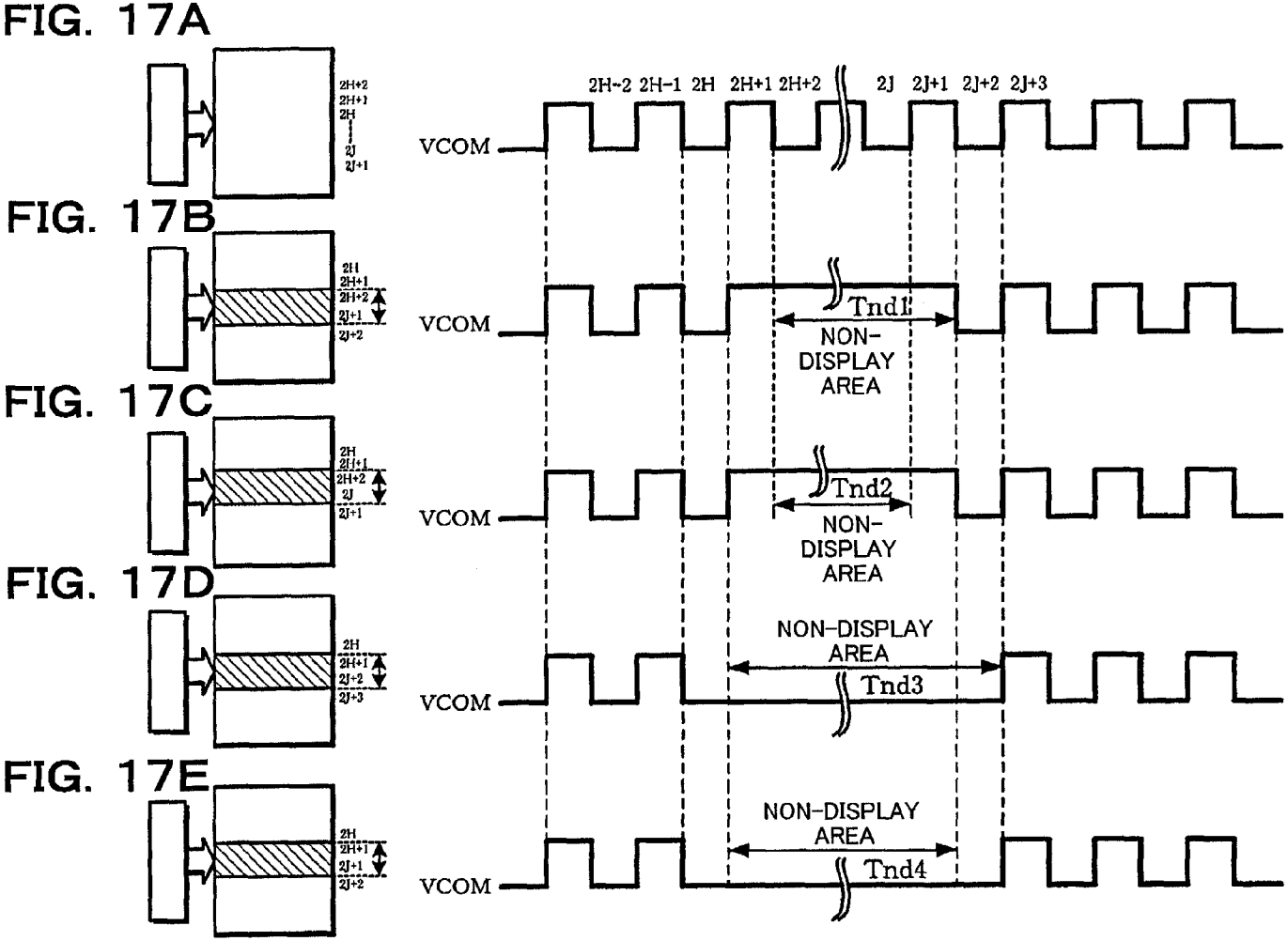
FIGS. 17A, 17B, 17C, 17D, and 17E are explanatory diagrams showing examples of the operation termination timing of the common electrode voltage polarization inversion signal VCOM.

In the case where all the scan lines are set for the display area, the common electrode voltage polarization inversion signal VCOM of which the polarity is reversed in one line scanning cycle is supplied using the line inversion drive method, as shown in FIG. 17A.

In the case where the scan line 2H+2 in which the polarity of the common electrode voltage polarization inversion signal VCOM is negative to the scan line 2J+1 in which the polarity of the common electrode voltage polarization inversion signal VCOM is positive are set for the non-display area, the polarity of the common electrode voltage polarization inversion signal is positive during a period Tnd1 shown in FIG. 17B. Therefore, polarization inversion is terminated in this period, whereby the power consumption can be reduced.

In the case where the scan line 2H+2 in which the polarity of the common electrode voltage polarization inversion signal VCOM is negative to the scan line 2J in which the polarity of the common electrode voltage polarization inversion signal VCOM is negative are set for the non-display area, the polarity of the common electrode voltage polarization inversion signal is positive during a period Tnd2 shown in FIG. 17C. This control timing is the same as that shown in FIG. 17B.

In the case where the scan line 2H+1 in which the polarity of the common electrode voltage polarization inversion signal VCOM is positive to the scan line 2J+2 in which the polarity of the common electrode voltage polarization inversion signal VCOM is negative are set for the non-display area, the polarity of the common electrode voltage polarization inversion signal is negative during a period Tnd3 shown in FIG. 17D.

In the case where the scan line 2H+1 in which the polarity of the common electrode voltage polarization inversion signal VCOM is positive to the scan line 2J+1 in which the polarity of the common electrode voltage polarization inversion signal VCOM is positive are set for the non-display area, the polarity of the common electrode voltage polarization inversion signal is negative during a period Tnd4 shown in FIG. 17E. This control timing is the same as that shown in FIG. 17D.

As described above, the line inversion drive can be realized by controlling the common electrode voltage polarization inversion signal VCOM. Moreover, power consumption can be further reduced by terminating the operation of the common electrode voltage polarization inversion signal VCOM in synchronization with the scan timing of the scan line in the block set for the non-display area. The operation of the polarization inversion signal POL may be terminated in the same manner as the common electrode voltage polarization inversion signal VCOM.

3.3 Configuration

Figure 18:
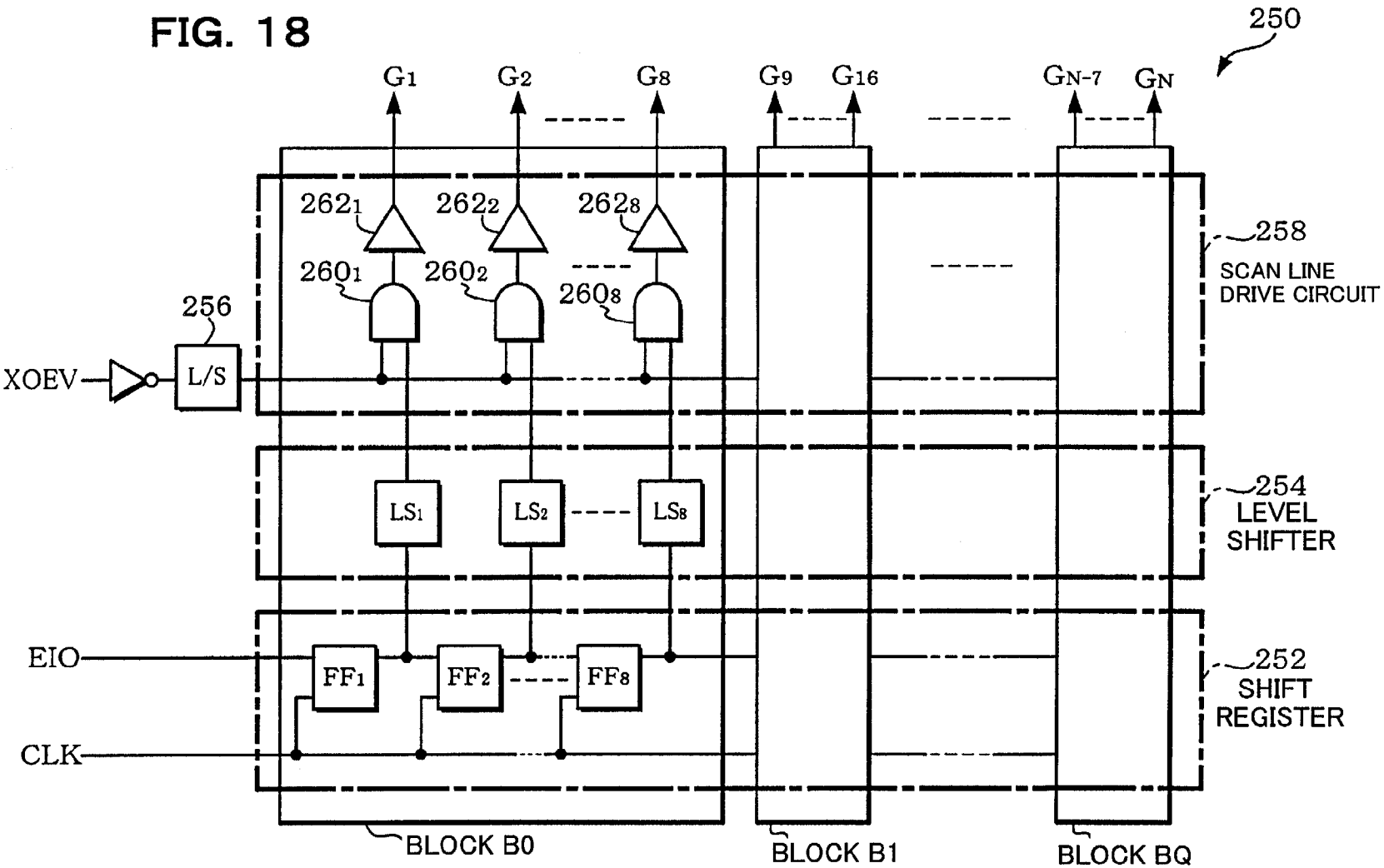
FIG. 18 is a block diagram showing an outline of a configuration of the scan driver of the second embodiment.

FIG. 18 shows a specific example of the configuration of the scan driver of the second embodiment.

A scan driver 250 of the second embodiment includes a shift register 252, L/S 254 and 256, and a scan line drive circuit 258.

In the shift register 252, $FF_1$ to $FF_N$ provided corresponding to the scan lines $G_1$ to $G_N$ are connected in series. The enable input/output signal EIO is supplied to the $FF_1$ (first FF) from the LCD controller 60. The clock signal CLK is supplied to the $FF_1$ to $FF_N$ from the LCD controller 60. Therefore, the $FF_1$ to $FF_N$ sequentially shift the enable input/output signal EIO (given pulse signal) in synchronization with the clock signal CLK.

The enable input/output signal EIO supplied from the LCD controller 60 is a vertical synchronization signal. The clock signal CLK supplied from the LCD controller 60 is a horizontal synchronization signal.

The L/S 254 includes level shifter circuits $LS_1$ to $LS_N$ (first to Nth level shifter circuits) provided corresponding to the scan lines $G_1$ to $G_N$, and shifts the voltage level on the high potential side of the data held by the corresponding $FF_1$ to $FF_N$ to a voltage level of 20 V to 50 V, for example.

The L/S 256 shifts the voltage level on the high potential side of the inversion signal of the output enable signal XOEV supplied from the LCD controller 60 to a voltage level of 20 V to 50 V, for example.

The scan line drive circuit 258 includes AND circuits $\mathbf{260}_1$ to $\mathbf{260}_N$ as mask circuits and CMOS buffer circuits $\mathbf{262}_1$ to $\mathbf{262}_N$ corresponding to the scan lines $G_1$ to $G_N$. The AND circuits $260_1$ to $260_N$ and the CMOS buffer circuits $262_1$ to $262_N$ are formed by a high breakdown voltage process which enables the operation at a voltage level of 20 to 50V, for example. This voltage level is determined depending upon the liquid crystal material for the LCD panel 20 to be driven or the like.

The scan driver 250 having the above configuration sequentially drives the scan lines set for the display area by the timing control of the output enable signal XOEV supplied from the LCD controller 60.

Specifically, the LCD controller 60 in which the entire display area of the LCD panel 20 is set for the display area by the host (not shown) supplies the vertical synchronization signal in a given vertical scanning cycle and the horizontal synchronization signal in a horizontal scanning cycle to the scan driver 250. The LCD controller 60 allows the output enable signal XOEV to remain at a logic level of "L", whereby the CMOS buffer circuits $262_1$ to $262_N$ sequentially drive each of the scan lines $G_1$ to $G_N$ at a potential corresponding to the logic level of the $LS_1$ to $LS_N$.

The LCD controller 60 in which the non-display area is set in the display area of the LCD panel 20 supplies the vertical synchronization signal and the horizontal synchronization signal at the above timing and the output enable signal XOEV of which the logic level becomes "H" in synchronization with the scan timing of the scan lines corresponding to the non-display area to the scan driver 250.

Specifically, since the scan lines $G_1$ to $G_N$ are selectively driven, the logic level of the output node of the LS is masked by the AND circuit by supplying the output enable signal XOEV according to the scan timing corresponding to the non-display area, and becomes a logic level of "L". Therefore, these scan lines are not driven. In the second embodiment, the partial display control is performed using a unit of eight scan lines as one block. Therefore, the LCD controller 60 supplies the output enable signal XOEV which is controlled in units of the blocks to the scan driver 250.

Figure 19:
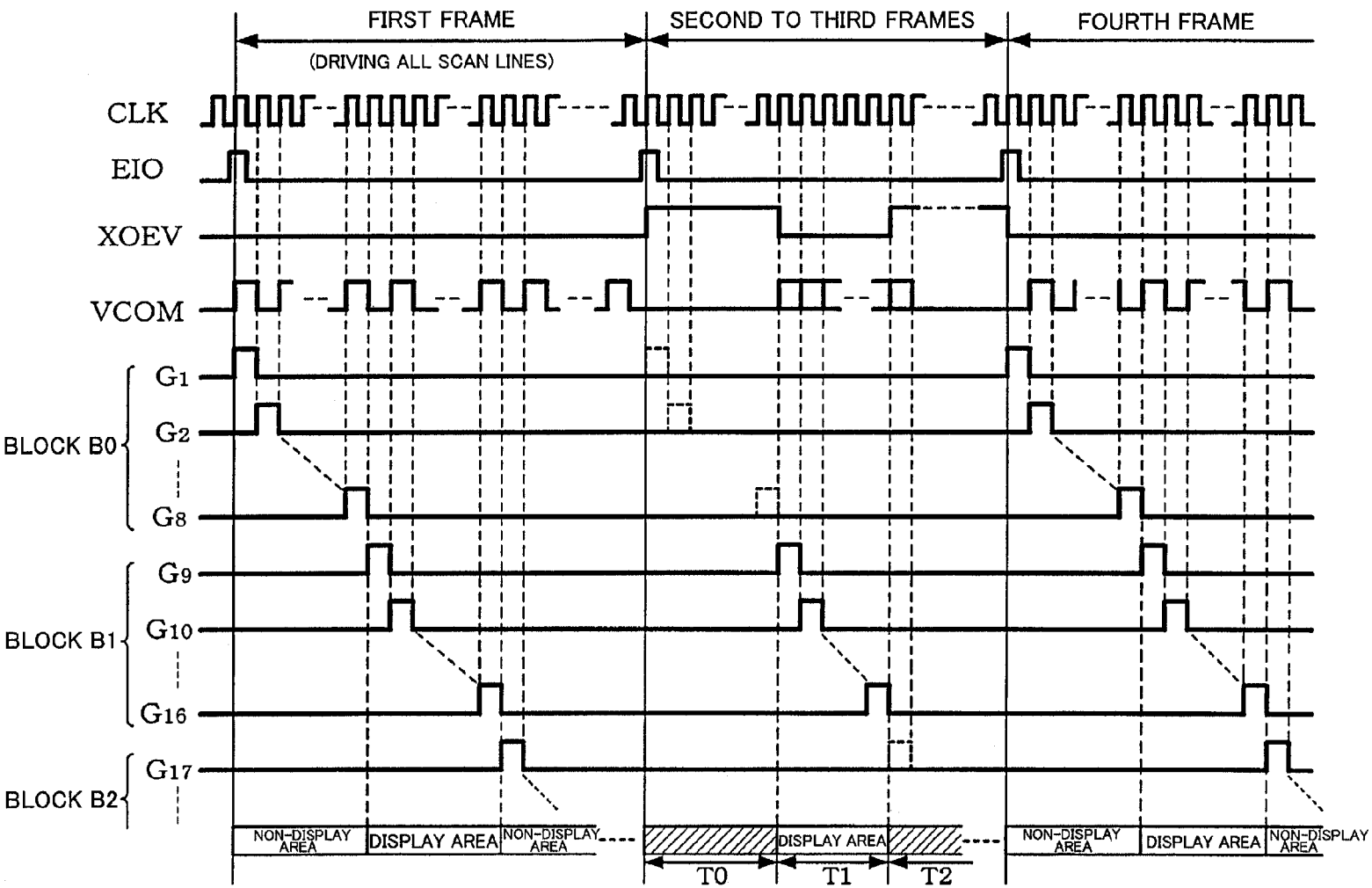
FIG. 19 is a timing chart showing an example of the partial display control timing of the scan driver of the second embodiment.

FIG. 19 shows an example of the partial display control timing by the scan driver 250 of the second embodiment.

In this example, only the block B1 is set for the display area and other blocks B0, B2, . . . are set for the non-display areas.

As described above, charges stored in the liquid crystal capacitances connected to the TFTs must be discharged in a given cycle in order to prevent deterioration of the liquid crystal. The scan driver 250 sequentially drives all the scan lines of the LCD panel 20 in an odd-numbered (2i−1, i is a natural number) frame cycle. If the scan driver 250 drives all the scan lines of the LCD panel 20 in one frame cycle (i=1), the effect of reducing power consumption by the partial display control cannot be obtained. Therefore, the cycle is preferably longer than three frames. This frame cycle is determined depending upon the liquid crystal material. The frame cycle can be set longer as the drive voltage is decreased. FIG. 19 illustrates a case where all the scan lines are sequentially driven in three (i=2) frame cycle.

The common electrode voltage polarization inversion signal VCOM of which the polarity is reversed in each scan line and in each frame is supplied in the frame in which all the scan lines are driven using the line inversion drive method.

The scan driver 250 sequentially drives all the scan lines in the first and fourth frames.

More specifically, the scan driver 250 captures the enable input/output signal EIO in the first and fourth frames in synchronization with the clock signal CLK, and sequentially shifts the signal in the $FF_1$ to $FF_N$ of the shift register 252. The LCD controller 60 supplies the output enable signal XOEV at a logic level of "L" to the scan driver 250 corresponding to the scan timing of the scan lines in each block. In the scan driver 250, the AND circuits $260_1$ to $260_N$ of the scan line drive circuit 258 supply the potential of the output nodes of the $LS_1$ to $LS_N$ to the CMOS buffer circuits $262_1$ to $262_N$. Therefore, the potential sequentially driven and connected to the signal lines is applied to the liquid crystal capacitances in the gate electrodes of the TFTs connected to the scan lines $G_1$ to $G_N$. At this time, a voltage of which the difference between the common electrode voltage Vcom of the liquid crystal capacitances is smaller than the given threshold value $V_{CL}$ of the liquid crystal is applied to the pixel electrodes of the liquid crystal capacitances. A voltage equal to the common electrode voltage Vcom of the liquid crystal capacitances may be applied to the pixel electrodes of the liquid crystal capacitances.

In the second and third frames between the first and fourth frames, the scan driver 250 sequentially drives only the scan lines corresponding to the display area, but does not drive the scan lines corresponding to the non-display area.

More specifically, the scan driver 250 captures the enable input/output signal EIO in synchronization with the clock signal CLK in the second and third frames, and sequentially shifts the signal in the $FF_1$ to $FF_N$ of the shift register 252. The LCD controller 60 supplies the output enable signal XOEV at a logic level of "H" to the scan driver 250 in synchronization with the scan timing T0 of the scan lines $G_1$ to $G_8$ in the block B0 set for the non-display area. Therefore, in the scan driver 250, the AND circuits $260_1$ to $260_8$ of the scan line drive circuit 258 mask the logic levels of the output nodes of the $LS_1$ to $LS_8$ and make the logic levels "L". This allows the potential on the lower potential side to be supplied to the gate electrodes of the TFTs connected to the scan lines $G_1$ to $G_8$.

The LCD controller 60 supplies the output enable signal XOEV at a logic level of "L" to the scan driver 250 in synchronization with the scan timing T1 of the scan lines $G_9$ to $G_{16}$ in the block B1 set for the display area. Therefore, in the scan driver 250, the AND circuits $260_9$ to $260_{16}$ of the scan line drive circuit 258 supply the potential of the output nodes of the $LS_9$ to $LS_{16}$ to the CMOS buffer circuits $262_9$ to $262_{16}$. This enables the gate electrodes of the TFTs connected to the scan lines $G_9$ to $G_{16}$ to be sequentially driven, whereby the potential connected to the signal lines is applied to the liquid crystal capacitances.

The LCD controller 60 supplies the output enable signal XOEV at a logic level of "H" to the scan driver 250 in synchronization with the scan timing T2 of the scan lines $G_{17}$ to $G_{24}$ in the block B2 set for the non-display area, thereby terminating the driving of the scan lines in the same manner as the scan timing T1.

The polarity of the common electrode voltage polarization inversion signal VCOM is fixed at either positive or negative corresponding to the scan timings T0 or T2 of the scan lines in the block set for the non-display area. This enables the power consumption accompanied by unnecessary polarization inversion to be reduced.

The first and second embodiments are described taking the active matrix type liquid crystal panel using a TFT liquid crystal as an example. However, the present invention is not limited thereto.

The present invention is not limited to the above-described embodiment. Various modifications and variations are possible without departing from the spirit and scope of the present invention. For example, the present invention can be applied not only to the drive of the LCD panel, but also to electroluminescent and plasma display devices.

In the above embodiments, the display device includes the LCD panel, scan driver, and signal driver. However, the present invention is not limited thereto. For example, the LCD panel may include the scan driver and signal driver.

What is claimed is:

1. A scan-driving circuit for realizing a partial display, the scan-driving circuit driving first to Nth scan lines (N is a natural number) of an electro-optical device having pixels specified by the first to Nth scan lines and first to Mth signal lines (M is a natural number), the first to Nth scan lines and the first to Mth signal lines intersecting each other, the scan-driving circuit comprising:

a shift register which includes serially connected first to Nth flip-flops provided corresponding to the first to Nth scan lines and sequentially shifts a given pulse signal;

a level converter circuit including first to Nth level shifter circuits which shift voltage levels of output nodes of the first to Nth flip-flops and output signals of the shifted voltage levels;

a scan line drive circuit including first to Nth drive circuits which sequentially drive the first to Nth scan lines corresponding to logic levels of output nodes of the first to Nth level shifter circuits;

a block select data holding circuit which holds block select data for designating a block in which scan lines are driven; and a bypass circuit which outputs one of shift input and shift output to a (P+1)th block based on the block select data set for the Pth block, the shift input being input to a front flip-flop in a Pth block (P is a natural number) which includes at least part of a first to Nth flip-flops which form the shift register, and shift output being output from a last flip-flop in the Pth block, the last flip-flop in the Pth block being coupled to a front flip-flop in the (P+1)th block, wherein, when the first to Nth scan lines are divided into blocks each of which includes a plurality of scan lines and selection of a display area of the partial display or a non-display area of the partial display is performed in units of the blocks, the scan line drive circuit sequentially drives scan lines in at least one of the blocks selected for the display area, and simultaneously drives at a given drive timing at least part of scan lines in at least one of the blocks selected for the non-display area, and wherein the scan line drive circuit drives scan lines in a block designated as a block in which scan lines are driven by the block select data, and simultaneously drives at least part of scan lines in a block designated as a block in which scan lines are not driven by the block select data at a given drive timing.

2. The scan-driving circuit as defined in claim 1, wherein the electro-optical device comprises pixel electrodes provided corresponding to the pixels through switching circuits connected to the first to Nth scan lines and the first to Mth signal lines, wherein, when polarity of a voltage applied to electro-optical elements corresponding to the pixel electrodes is reversed in synchronization with a polarization inversion signal which reverses one of first and second voltage levels in each frame, the scan line drive circuit drives scan lines in a block designated as a block in which scan lines are driven by the block select data, and simultaneously drives a first group of scan lines among the scan lines in the block designated as a block in which scan lines are not driven by the block select data when the polarization inversion signal is at a first voltage level in a predetermined period which includes the drive timing, and simultaneously drives a second group of scan lines among the scan lines in the block designated as a block in which scan lines are not driven by the block select data when the polarization inversion signal is at a second voltage level in the predetermined period.

3. The scan-driving circuit as defined in claim 1, wherein the drive timing is set in a blanking interval in one vertical scanning period.

4. The scan-driving circuit as defined in claim 1, wherein each of the blocks corresponds to eight scan lines.

5. A display device comprising:

an electro-optical device having pixels specified by first to Nth scan lines (N is a natural number) and a plurality of signal lines, the first to Nth scan lines and the plurality of signal lines being intersect each other;

the scan-driving circuit as defined in claim 1 which drives the first to Nth scan lines; and a signal drive circuit which drives the signal lines based on image data.

6. An electro-optical device comprising:

pixels specified by first to Nth scan lines (N is a natural number) and a plurality of signal lines, the first to Nth scan lines and the plurality of signal lines being intersect each other;

the scan-driving circuit as defined in claim 5 which drives the first to Nth scan lines; and a signal drive circuit which drives the signal lines based on image data.

7. An electro-optical device comprising:

pixels specified by first to Nth scan lines (N is a natural number) and a plurality of signal lines, the first to Nth scan lines and the plurality of signal lines being intersect each other;

the scan-driving circuit as defined in claim 1 which drives the first to Nth scan line; and a signal drive circuit which drives the signal lines based on image data.

8. A scan-driving circuit for realizing a partial display, the scan-driving circuit driving first to Nth scan lines (N is a natural number) of an electro-optical device having pixels specified by the first to Nth scan lines and first to Mth signal lines (M is a natural number), the first to Nth scan lines and the first to Mth signal lines intersecting each other, the scan-driving circuit comprising:

a shift register which includes serially connected first to Nth flip-flops provided corresponding to the first to Nth scan lines and sequentially shifts a given pulse signal;

a level converter circuit including first to Nth level shifter circuits which shift voltage levels of output nodes of the first to Nth flip-flops and output signals of the shifted voltage levels;

a scan line drive circuit including first to Nth drive circuits which sequentially drive the first to Nth scan lines corresponding to logic levels of output nodes of the first to Nth level shifter circuits;

a block select data holding circuit which holds block select data for designating a block in which scan lines in a display area of the partial display are driven in a unit of eight scan lines; and a bypass circuit which outputs one of shift input and shift output to a (P+1)th block based on the block select data set for the Pth block, the shift input being input to a front flip-flop in a Pth block (P is a natural number) which includes at least part of a first to Nth flip-flops which form the shift register, and shift output being output from a last flip-flop in the Pth block, wherein the electro-optical device comprises pixel electrodes provided corresponding to the pixels through switching circuits connected to the first to Nth scan lines and the first to Mth signal lines, wherein, when polarity of a voltage applied to electro-optical elements corresponding to the pixel electrodes is reversed in synchronization with a polarization inversion signal which reverses one of first and second voltage levels in each frame, the scan line drive circuit drives scan lines in a block designated as a block in which scan lines in the display area are driven by the block select data, and simultaneously drives all of even-numbered scan lines in the block designated as a block in which scan lines in a non-display area of the partial display are not driven by the block select data when the polarization inversion signal is at a first voltage level in a predetermined period in one vertical scanning period, and simultaneously drives all of odd-numbered scan lines in the block designated as a block in which scan lines in the non-display area are not driven by the block select data when the polarization inversion signal is at a second voltage level in the predetermined period.

9. A display device comprising:

an electro-optical device having pixels specified by first to Nth scan lines (N is a natural number) and a plurality of signal lines, the first to Nth scan lines and the plurality of signal lines being intersect each other;

the scan-driving circuit as defined in claim 8 which drives the first to Nth scan lines; and a signal drive circuit which drives the signal lines based on image data.

10. An electro-optical device comprising:

pixels specified by first to Nth scan lines (N is a natural number) and a plurality of signal lines, the first to Nth scan lines and the plurality of signal lines being intersect each other;

the scan-driving circuit as defined in claim 8 which drives the first to Nth scan lines; and a signal drive circuit which drives the signal lines based on image data.

11. A method of driving a scan-driving circuit for realizing a partial display, the scan-driving circuit driving a plurality of scan lines of an electro-optical device having pixels specified by the plurality of scan lines and a plurality of signal lines, the scan lines and the signal lines intersecting each other, the method comprising:

when polarity of a voltage applied to electro-optical elements corresponding to the pixels is reversed in synchronization with a polarization inversion signal which reverses one of first and second voltage levels in each frame, sequentially driving scan lines in a block designated as a block in which scan lines in a display area of the partial display are driven by block select data which designates a block in which scan lines are driven, in a unit of eight scan lines; and simultaneously driving all of even-numbered scan lines in the block designated as a block in which scan lines in a non-display area of the partial display are not driven by the block select data when the polarization inversion signal is at a first voltage level in a predetermined period in one vertical scanning period, and simultaneously driving all of odd-numbered scan lines in the block designated as a block in which scan lines in the non-display area are not driven by the block select data when the polarization inversion signal is at a second voltage level in the predetermined period.

* * * * *